US005634390A

United States Patent [19]

Takeuchi et al.

[11] Patent Number: 5,634,390

[45] Date of Patent: Jun. 3, 1997

[54] ROTARY ACTUATOR

[75] Inventors: Terumasa Takeuchi; Yoshinori Nozawa; Daizyu Maki; Yasuhiro Yoshida; Tadashi Endo; Keiichi Inaba, all of Komaki, Japan

[73] Assignee: CKD Corporation, Japan

[21] Appl. No.: 548,258

[22] Filed: Oct. 25, 1995

[30] Foreign Application Priority Data

| | | | |
|---|---|---|---|
| Nov. 19, 1994 | [JP] | Japan | 6-309608 |
| Feb. 2, 1995 | [JP] | Japan | 7-039018 |
| Mar. 27, 1995 | [JP] | Japan | 7-094472 |
| Apr. 21, 1995 | [JP] | Japan | 7-120922 |
| May 30, 1995 | [JP] | Japan | 7-157060 |

[51] Int. Cl.[6] ..... F01B 3/00

[52] U.S. Cl. ..... 92/33; 92/32; 92/5 R; 74/424.8 B; 74/89

[58] Field of Search ..... 92/31, 32, 33, 92/5 R; 74/424.8 B, 490.09, 89

[56] References Cited

U.S. PATENT DOCUMENTS

| | | | |
|---|---|---|---|
| 4,590,816 | 5/1986 | Weyer | 74/424.8 B |
| 5,203,222 | 4/1993 | Hirai | 74/424.8 B |
| 5,241,895 | 9/1993 | Weyer | 92/33 |
| 5,299,489 | 4/1994 | Obrecht et al. | 92/5 R |
| 5,456,134 | 10/1995 | Bouwer et al. | 74/89 |

FOREIGN PATENT DOCUMENTS

| | | |
|---|---|---|
| 60-44607 | 3/1985 | Japan . |
| 62-46005 | 2/1987 | Japan . |
| 62-162401 | 10/1987 | Japan . |

OTHER PUBLICATIONS

H 1191 U.S. Statutory Invention Registration Jun. 1993 (Hutchison et al).

*Primary Examiner*—Thomas E. Denion

[57] ABSTRACT

Disclosed is a rotary actuator utilizing magnetic screws which are stably rotatable at a great torque with little torque variation. The rotary actuator comprising (a) a closed hollow cylinder, a piston sliding within the cylinder, and a rotary shaft which rotates with the sliding of the piston, has (b) a first magnetic screw member which makes a linear motion in synchronism with the sliding of the piston, and is provided with a first spiral magnetized band, and (c) a rotary shaft rotatably supported in relation to the first magnetic screw member, and having a second magnetic screw provided with a second spiral magnetized band. (d) With the sliding of the piston, the second magnetic screw receives the magnetic force from the first magnetic screw to thereby rotate the rotating shaft.

20 Claims, 17 Drawing Sheets

ROTARY ACTUATOR

BACKGROUND OF THE INVENTION

1. Field of the Invention

The present invention relates to a rotary actuator and, more particularly to a rotary actuator in which a magnetic screw is formed on each piston and rod so that the rod will be rotated with the stroke of the piston.

2. Description of Related Art

There have been used various types of rotary actuators utilizing a fluid such as the compressed air as a source of driving force.

Conventional vane type rotary actuators and rack-and-pinion type rotary actuators, however, have such a problem that their bodies are required to be extended in a direction meeting at right angles with a rod, and accordingly the use of a larger rotary actuator is needed.

Furthermore, the vane type rotary actuator has such a problem that fluid leakage occurs between a seal and a vane.

The present applicant has proposed a rotary actuator using a screw for the purpose of solving the above-described problems.

FIG. 19 shows a ball-screw type rotary actuator as a prior art example, which has been proposed by the present applicant in Japanese Patent Laid-Open No. Sho 60-44607.

A rod 122 is rotatably supported on a couple of rotating bearings 128 through a cylinder body 129. At the central portion of the rod 122 is formed a stepped section 123, and around the stepped section 123 is formed a ball groove 124 in a spiral form. Inside the cylinder body 129 is slidably fitted a piston 121 moveable in an axial direction relative to the rod 122. To the piston 121 is fixedly installed a ball retaining member 126 for retaining a plurality of balls 125 as one unit. The balls 125 are inserted in the ball groove 124 of the stepped section 123. Also in a guide hole formed in the piston 121 is fitted a guide rod 127 provided on the cylinder body 129.

Therefore, as the piston 121 slides in relation to the rod 122, the rod 122 rotates through the balls 125.

The interior of the cylinder body 129 is divided into right and left chambers by the piston 121.

Next, the operation of the ball-screw type rotary actuator having the above-described constitution will be explained. When the compressed air flows into the right chamber of the piston 121, the piston 121 slides to the position shown in FIG. 19. At this time, the rod 122 is rotated clockwise, as viewed from the left, by the operation of the balls 125. Also, as the compressed air flows into the left chamber of the piston 121, the piston 121 slides as far as the position where the piston 121 contacts the right-hand wall of the cylinder body 129. At this time, the rod 122 rotates counterclockwise as viewed from the left through the balls 125.

Next, the construction of the screw type rotary actuator is shown as the second prior art example in FIGS. 20 and 21, which has been proposed by the present applicant in Japanese Utility Model Laid-Open No. Sho 62-162401.

A rod 132 mounted through a cylinder body 139 is rotatably supported on two rotating bearings 138. At the central part of the rod 132 is formed a step-like external screw section 133.

In the cylinder body 139, a piston 131 is so fitted as to be axially slidable on the rod 132. An internal screw member 136 engaged with an external screw section 133 is fixedly installed as one unit to the piston 131. The piston 131, as shown in FIG. 21, is elliptical in a sectional form, so that it will not rotate.

Therefore, with the sliding of the piston 131 on the rod 132, the rod 132 is rotated by the operation of the external screw section 133 and the internal screw member 136.

The interior of the cylinder body 139 is separated into the right and left chambers by the piston 131.

Next, the operation of the screw type rotary actuator having the above-described constitution will be explained. With the inflow of the compressed air into the left chamber of the piston 131, the piston 131 slides as far as a position shown in FIG. 20. At this time, the rod 132 is rotated counterclockwise as viewed from the left, by the operation of the external screw section 133 and the internal screw member 136. Also with the inflow of the compressed air into the right chamber of the piston 131, the piston 131 slides as far as a position in which the piston 131 contacts the left wall of the cylinder body 139. At this time, the rod 132 is rotated clockwise as viewed from the left side, by the operation of the external screw section 133 and the internal screw member 136.

However, the prior art ball-screw type rotary actuator and the screw type rotary actuator have the following problems.

That is, because of a low torque transmission efficiency of the screw, it is demanded to build a large-sized rotary actuator capable of producing a required torque. Besides, since the ball screw transmits the torque through a local contact surface, an increased surface pressure and accordingly a short life will result.

To solve these problems of the prior art ball-screw type rotary actuator and the screw type rotary actuator, the present applicant has suggested the adoption of a magnetic screw in place of the screw and the ball screw types in Japanese Patent Laid-Open No. Sho 62-46005.

In FIG. 22 is shown the constitution thereof. A rod 141 mounted through a cylinder 146 is provided with a stepped section at the center, and a spiral magnetized band 142 is formed on the surface. In the meantime, in the groove 144 of a piston 143, two guide magnets 145 which are permanent magnets are embedded and fixedly attached. The two guide magnets 145 slide within the cylinder 146 together with the piston 143.

Furthermore, the laid-open gazette tells, on the 12th through 16th lines in the left lower column on page 3, "as a modification of the present embodiment, a spiral guide magnet may be provided on the inner periphery of the center hole of the piston, and a block type driven magnet may be provided on the outer periphery of the rotor. In this case, also the rotor rotates with the up-and-down stroke of the piston."

In the above-described constitution, the rod 141 rotates with the sliding of the piston 143.

According to the laid-open gazette (3rd through 11th lines at the right upper column on page 4), this invention has such an advantage that the rotary actuator of the present invention needs no high sealing technique because those parts which make relative movement at the time of driving are properly sealed with an O-ring; and since a spiral permanent magnet is used on one side of permanent magnets attracting each other to rotate the output shaft, the maximum rotation angle of the output shaft can be increased to 360 degrees or over by providing a small lead of spiral groove or by extending the cylinder in an axial direction.

The prior art magnetic screw type rotary actuator disclosed in Japanese Patent Laid-Open No. Sho 62-46005, however, has the following problems.

(1) Since a spiral permanent magnet is provided on the rod, or on one side of the permanent magnets in the piston hole, and a square block type permanent magnet is provided on the other side, the rod rotates unsmoothly and nonuniformly during the sliding of the piston.

(2) Since the permanent magnet is only partly fitted in the piston, there exist both the angle of attraction and the angle of non-attraction of the permanent magnets, resulting in nonuniform rotation of the rod.

Furthermore, the transmission torque at the magnetic screw, that is, a coupling power between the rod and the piston, is small; the use of a large type apparatus, therefore, becomes necessary to obtain the coupling power required; otherwise the above-described problem of the prior art rotary actuator cannot be solved.

(3) A spiral magnetized band formed on the rod is composed of laminated permanent magnets, in which no accurate magnetized band can be formed because of an inaccurate continued section, causing unsmooth, nonuniform rod rotation.

Furthermore, there are such problems as an increased number of assembling processes and a high cost.

Particularly when the permanent magnets are bonded to the inner periphery of the piston, joints tend to contact the rod, resulting in unsmooth rod rotation.

(4) The O-ring 140 is used as a sealing material for the purpose of preventing air leakage between the piston 131 and the rotating rod 132; however, in the case of the magnetic screw type rotary actuator, which employs a magnetic screw type coupling, has not so great a coupling power. Therefore, if an elastic member such as the O-ring 140 is held in direct contact for sealing with the rotating rod 132, the effective torque of the rotating rod 132 will decrease due to the effect of frictional force of the O-ring 140.

(5) Furthermore, when an elastic seal like the O-ring 140 is used, the frictional force varies with a change in the pressure of the compressed air which is a working fluid, or with a change in the rotational speed of the rotating rod 132, resulting in a variation in the output torque. This is disadvantageous in keeping a constant output torque.

(6) For detecting the angle of rod rotation, the rotational position of a hand mounted on the rod is directly detected by means of a limit switch. It is, therefore, necessary to mount a limit switch or the like in the rotational position of the hand; the limit switch, however, is very inconvenient because it is likely to interfere with hand manipulation and to decrease a surrounding space.

Furthermore, to detect the rotational position of the rod from time to time, it is necessary to mount a rotation angle detector such as a rotary encoder in connection with the rod. The rotary encoder, however, is large in size, inconvenient for mounting, and besides expensive.

SUMMARY OF THE INVENTION

It is a first object of the present invention to provide a rotary actuator utilizing a magnetic screw which is able to make stabilized rotation with a great torque and with little torque variation.

It is a second object of the present invention to provide a rotary actuator which is compact in size, has a long life and a high torque transmission efficiency, and is capable of easily detecting the rotation angle.

It is a third object of the present invention to provide a rotary actuator which is easily manually operatable.

It is a fourth object of the present invention to provide a rotary actuator which enables free setting of the rotation angle.

It is a fifth object of the present invention to provide a rotary actuator capable of performing free, linear control of the rotation angle.

To accomplish the above-described objects, the rotary actuator of the present invention has the following constitution.

(1) A rotary actuator having a closed hollow cylinder, a piston sliding within the cylinder, and a rotary shaft rotating with the sliding of the piston, comprises a first magnetic screw member provided with a first spiral magnetized band which makes a linear motion in synchronization with the sliding of the piston; and the aforesaid rotary shaft rotatably supported by the first magnetic screw member, and provided with a second magnetic screw having a second spiral magnetized band; the second magnetic screw receives a magnetic force from the first magnetic screw with the sliding of the piston, thereby rotating the rotary shaft.

(2) Furthermore, in the rotary actuator described above in (1), the first magnetic screw member is connected, on the outside of the cylinder, with a rod which is formed integrally with the piston; and the rotary shaft is rotatably installed to the first magnetic screw member on the outside of the cylinder.

(3) Furthermore, in the rotary actuator described above in (1), the first magnetic screw is formed integrally with the piston; and the rotary shaft stated above is rotatably mounted to the first magnetic screw within the cylinder, with one end thereof protruding out of the end member of the cylinder.

The piston of the rotary actuator constituted as described above is given a driving force by a fluid supplied to the cylinder, sliding in the cylinder. At this time, the first magnetic screw member makes a linear motion in synchronism with the piston. The magnetic force of the first magnetized band of this first magnetic screw member works on the second magnetized band formed on the second magnetic screw of the rotary shaft, thus turning the rotary shaft.

That is, when the piston is at a stop, the first magnetic screw and the second magnetic screw, attracting each other, are stabilized at rest. Then, with the sliding of the piston, the first screw and the piston make a linear motion in synchronism. The second magnetic screw receives the magnetic force from the first magnetic screw that is making the linear motion. Here, the rotary shaft supported on a rotating bearing is in a free state in the direction of rotation, and therefore the rotary shaft rotates correspondingly to the position of the first magnetic screw.

Since the first magnetized band and the second magnetized band are both formed in a continuous spiral form, the rotary shaft rotates smoothly and therefore there will occur no nonuniform rotation.

That is, the external magnetic screw formed integrally with the piston has a spiral magnetized band on the entire outer periphery and also the internal magnetic screw formed integrally with the rod has a spiral magnetized band on the entire inner periphery. As the piston slides, the internal magnetic screw receives a magnetic force from the external magnetic screw, thereby rotating the rod smoothly. Therefore, there will never take place any nonuniform rotation.

According to the constitution described in (2), the first magnetic screw member is connected with the rod protruding out of the cylinder; therefore a sealing means of the same constitution as an ordinary fluid cylinder is usable for preventing leakage of a fluid for driving the piston. It, therefore, is possible to easily prevent the fluid leakage.

Furthermore, according to the constitution described in (3), the first magnetic screw is formed integrally with the piston, and the rotary shaft protrudes out of the end member of the cylinder. It, therefore, is possible to build the whole body of the rotary actuator compact.

According to the rotary actuator of the present invention, as explained in detail, the rotary actuator comprises the closed hollow cylinder, the piston sliding within the cylinder, and the rotary shaft rotating with the sliding of the piston; the rotary shaft having the first magnetic screw member which makes a linear motion in synchronization with the sliding of the piston and is formed integrally with the first spiral magnetized band, and the second magnetic screw on which the second spiral magnetized band is formed; and as the piston slides, the second magnetic screw receives a magnetic force from the first magnetic screw, thereby rotating the rotary shaft. Therefore, the rotary shaft can smoothly rotate without nonuniform rotation. Moreover a great deal of torque can be produced.

Furthermore, since the sealing means of the same constitution as the common fluid cylinder is usable for preventing the leakage of the piston driving fluid when the first magnetic screw connected to the rod protruding out of the cylinder is adopted, the fluid leakage can easily be prevented. Also, because the cylinder section and the rotary shaft section are separated, the rotary shaft is little affected by any change arising with the cylinder such as a change in the sliding resistance of the piston and by a variation in the air pressure; therefore, the rotary shaft can rotate smoothly at a constant torque.

Furthermore, it is possible to build a compact rotary actuator on the whole by adopting the constitution that the first magnetic screw is formed integrally with the piston and the rotary shaft protrudes out of the end member of the cylinder.

The foregoing and other objects will become more apparent and understandable from the following detailed description thereof, when read in connection with the accompanying drawings.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention. In the drawings.

DETAILED DESCRIPTION OF THE PREFERRED EMBODIMENTS

Hereinafter preferred embodiments of a rotary actuator according to the present invention will be explained in detail with reference to the accompanying drawings.

Figure 1:
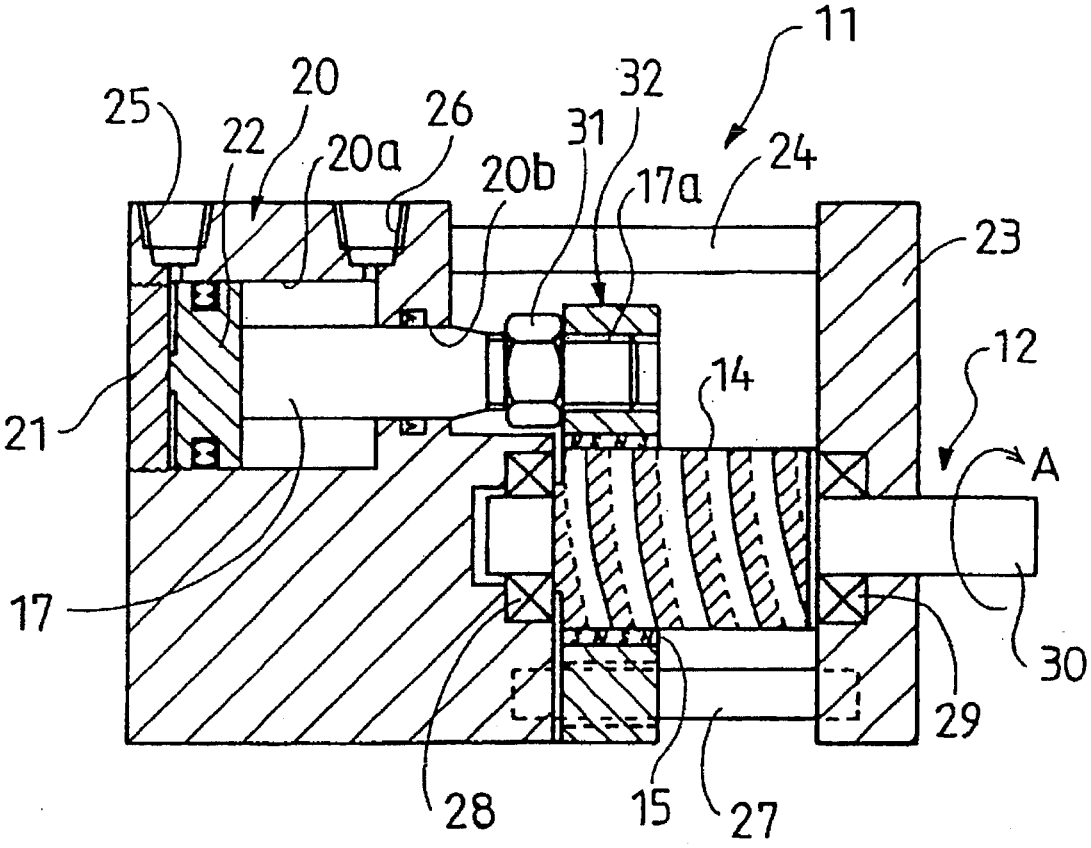
FIG. 1 is a sectional view showing the constitution of a rotary actuator 11 in a first embodiment according to the present invention.

FIG. 1 is a sectional view showing the constitution of a rotary actuator 11 in a first embodiment. A closed hollow cylinder comprises a hollow cylinder-shaped cylinder tube 20 and an end cover 21 which closes the left end of the cylinder tube 20. In the hollow section 20*a* of the cylinder tube 20, a piston 22 is slidably inserted. At the center of the right end face of the piston 22, a rod 17 is fixedly mounted. The right end of the rod 17 protrudes out of the cylinder through a bore 20*b* formed at the center of the hollow section 20*a* of the cylinder tube 20.

In the cylinder tube 20 are formed air ports 25 and 26 for supplying the compressed air.

On the right side of the cylinder tube 20, a rotary shaft bracket 23 is fixedly mounted through a support bar 24 and a guide bar 27. A rotary shaft 12 is rotatably supported on a bearing 28 fixedly mounted in the cylinder tube 20 and on a bearing 29 fixedly mounted on a rotary shaft bracket 23. On the right end of the rotary shaft 12 is formed a rotary shaft section 30, which protrudes out from the rotary shaft bracket 23.

At the central part of the rotary shaft 12, a large-diameter external magnetic screw 14 is formed. An internal magnetic screw holder 32 having an internal magnetic screw 16 formed in the inner periphery thereof is mounted to rotate around the external magnetic screw 14. The upper part of the internal magnetic screw holder 32 is fastened by means of a mounting screw section 17*a* formed on the forward end of the rod 17 and a lock bolt 31. Furthermore, the lower part of the internal magnetic screw holder 32 is slidably fitted on the guide bar 27.

Figure 3:
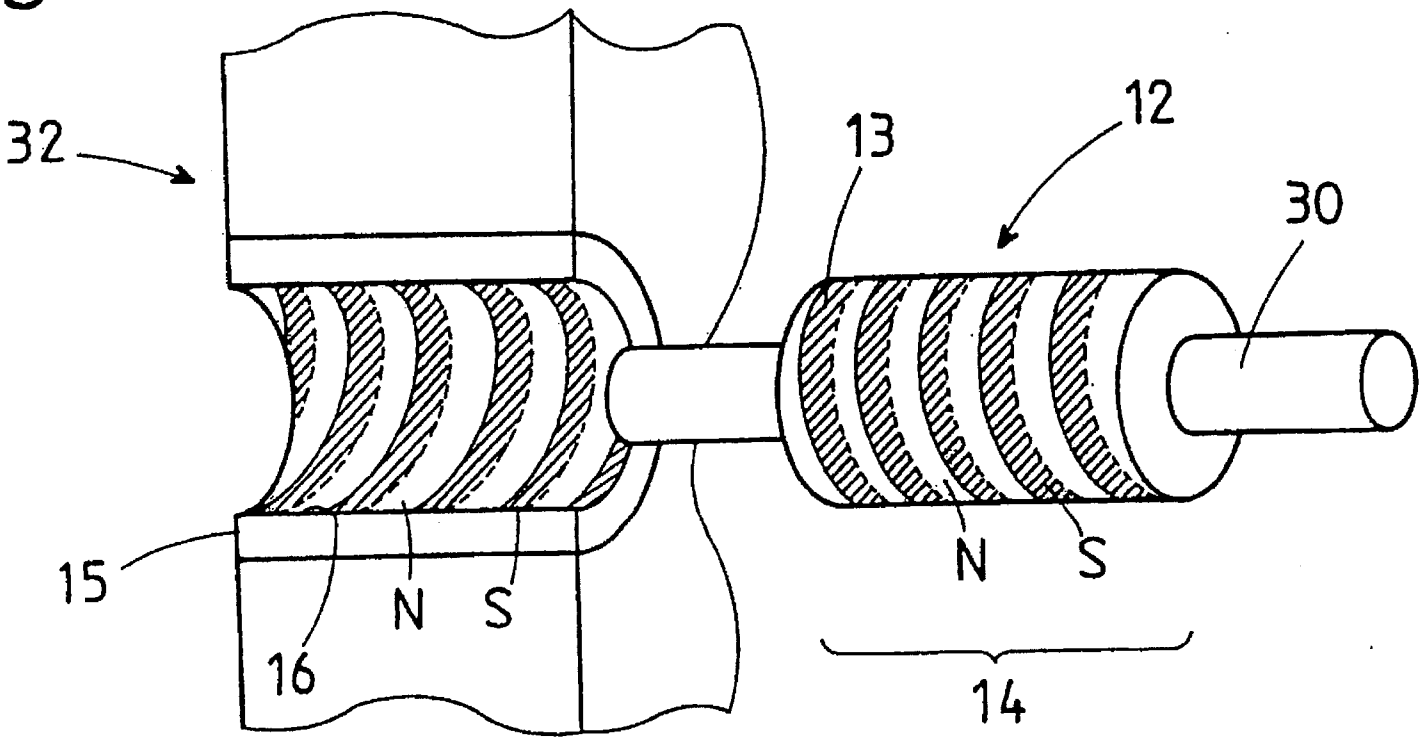
FIG. 3 is an explanatory view showing the constitution of an external magnetic screw 14 and an internal magnetic screw 15 in the first embodiment.

Next, the constitution of the magnetic screw will be explained in detail. The rotary shaft 12, as shown in FIG. 3, comprises the rotary shaft section 30, and the external magnetic screw 14 which is an external spiral cylindrical magnet fitted and bonded on the outer periphery at center of the rotary shaft section 30.

The rotary shaft section 30 is formed of a high-permeability material (e.g., iron, iron oxide, nickel, cobalt, or an alloy made of these materials as main constituents, and other compounds).

The external magnetic screw 14 is a cylindrical magnet having a plurality of spiral magnetized bands 13. Contiguous magnetized bands 13 have opposite polarities; that is, when a certain magnetized band 13 has a north polarity N on the outside surface, an adjacent magnetized band 13 has a south pole S on the outside surface.

On the surface of the external magnetic screw 14, magnetized bands 13 with the north pole N and the south pole S arranged alternately in a spiral form are formed in good order.

Inside the internal magnetic screw holder 32 is fixedly provided an internal magnetic screw 15 in a position corresponding to the external magnetic screw 14.

The internal magnetic screw 15 is a hollow cylindrical spiral internal magnet as shown in FIG. 3, and is secured on the inner periphery of the internal magnetic screw holder 32 which is a jacket member formed of high-permeability materials (e.g., iron, iron oxide, nickel, cobalt, or an alloy composed of mainly these materials, and other compounds).

On the inner periphery of the internal magnetic screw 15 is formed a magnetized band 16 having the north pole N and the south pole S alternately arranged in a spiral form.

The external magnetic screw 14 and the internal magnetic screw 15 of the above-described constitution have the following features.

The external and internal magnetic screws 14 and 15 have excellent mechanical strength because it is possible to insert a strengthening member in the hollow section or to cover the surrounding section with the strengthening member. In the magnetic screw shown in FIG. 3, the rotary shaft section 30 and the internal magnetic screw holder 32 are equivalent to these strengthening members. Since the mechanical strength is secured by the use of this strengthening member, the external magnetic screw 14 and the internal magnetic screw 15 are excellent magnetic materials and may be composed of a brittle ferrite or rare earth material. It is possible to further effectively utilize a great magnetic force of the external magnetic screw 14 and the internal magnetic screw 15 by the use of a strengthening member composed of a high-permeability material.

Next, operation of the rotary actuator 11 of the above-described constitution will be explained.

FIG. 1 shows the rotary actuator with the piston 22 held on the left side with the compressed air supplied through the air port 26.

Next, the supply of the compressed air switched from the air port 26 to the air port 25 will be explained.

The piston 22, pushed by the compressed air, moves to the right. With the rightward movement of the piston 22, the internal magnetic screw holder 32 fixedly mounted on the forward end of the rod 17 also moves together. Here, the internal magnetic screw holder 32, being fitted on the guide bar 27, slides parallelly without rotating.

In the present embodiment, since the piston inserted in the cylinder in use has a round sectional form, the guide bar 27 is needed to lock from rotation. The guide bar 27, however, can be dispensed with by using a cylinder having a piston of an elliptic sectional form, and moreover the constitution on the whole can be made compact.

With the rightward movement of the internal magnetic screw holder 32, the internal magnetic screw 15 also moves together; and accordingly the external magnetic screw 14 receives a magnetic force from the internal magnetic screw 15, rotating the rotary shaft 12 clockwise as viewed from the right as indicated by the arrow A in the drawing.

Here, the internal magnetic screw 15 provided integrally with the piston 22 has a spiral magnetized band 16 on the entire inner periphery, and the external magnetic screw 14 provided integrally with the rotary shaft 12 has a spiral magnetized band 13 on the entire outer periphery, so that, with the sliding of the piston 22, the external magnetic screw 14 receives a magnetic force from the internal magnetic screw 15, allowing smooth, stable rotation of the rotary shaft 12.

The rotary actuator 11 in the first embodiment, as has been explained in detail, has (a) the rod 17 connected to the piston 22, with its one end protruding out of the cylinder tube 20, (b) the internal magnetic screw 15 connected to the rod 17 and having the spiral magnetized band 16 formed in parallel with the direction of sliding of the piston 22, and (c) the rotary shaft 12 rotatably inserted in the internal magnetic screw 15, and provided with the external magnetic screw 14 having the spiral magnetized band 13; and (d) with the sliding of the piston 22, the external magnetic screw 14 receives the magnetic force from the internal magnetic screw 15 to rotate the rotary shaft 12. Since the cylinder section is separated from the rotary shaft section, the rotary shaft 12 is little affected by any change arising in the cylinder section such as a change in the sliding resistance of the piston 22 and a change in the air pressure, thereby enabling smooth rotation of the rotary shaft 12 and maintaining a constant torque of the rotary shaft 12.

Figure 2:
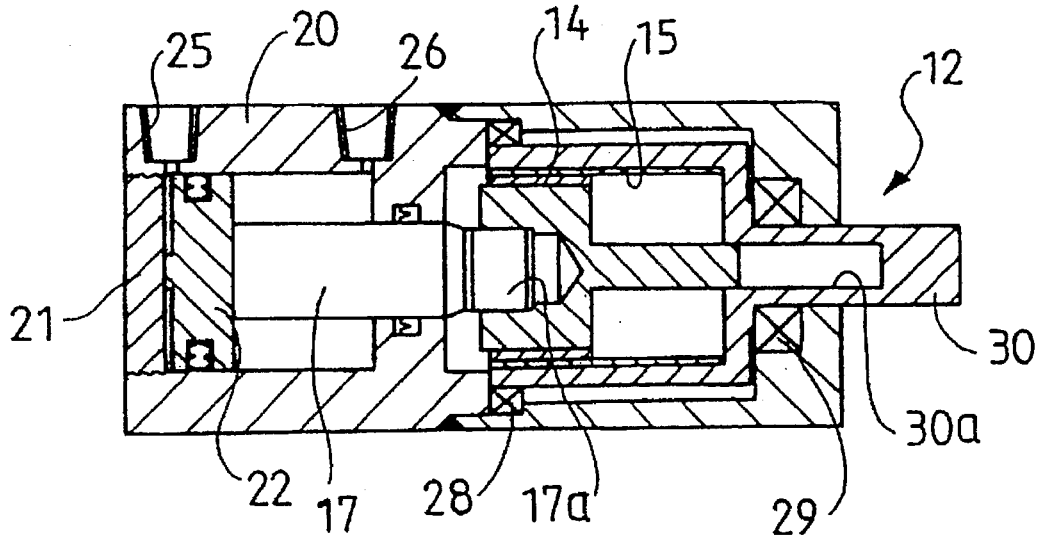
FIG. 2 is a sectional view showing the constitution of a rotary actuator 11 in a second embodiment according to the present invention.

Next, a second embodiment of the present invention will be explained. FIG. 2 is a sectional view showing the constitution of a rotary actuator 11 in the second embodiment. A great difference of the second embodiment from the first embodiment lies in the respect that an external magnetic screw 14 is mounted on the forward end of a rod 17, and an internal magnetic screw 15 is mounted on a rotary shaft 12 side. It should be noted that elements having the same functions as those of the first embodiment are designated by the same reference numerals, and will be explained. In addition, the explanation will be made with major emphasis placed on different points.

Figure 4:
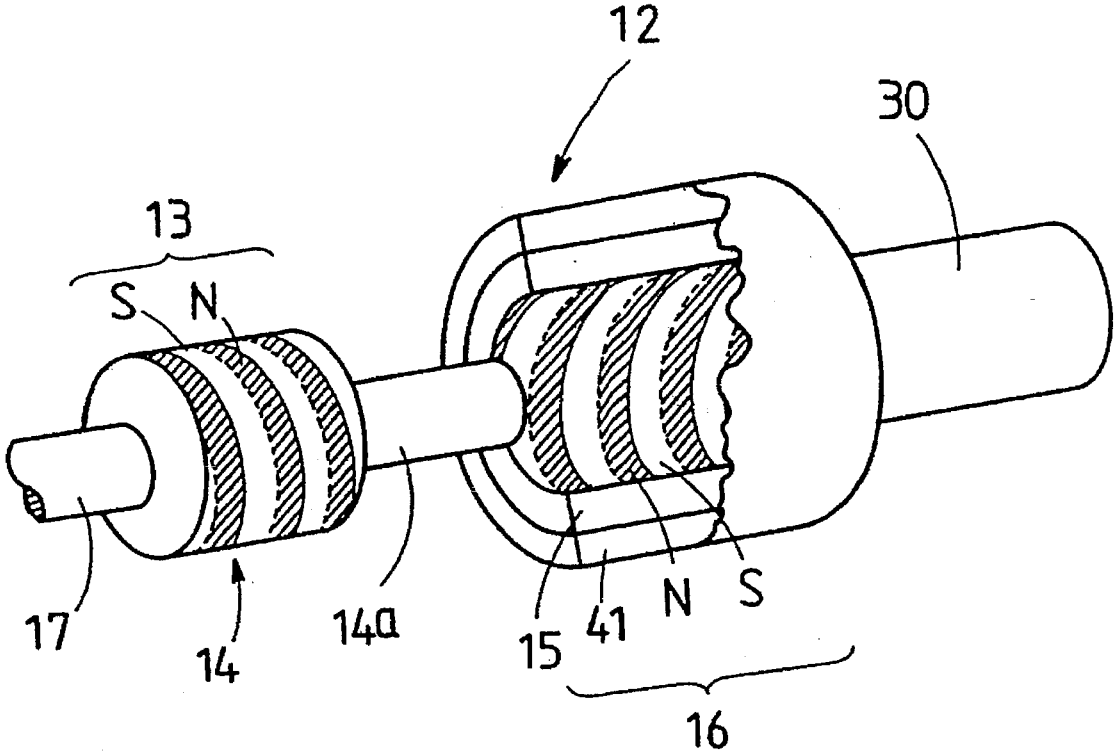
FIG. 4 is an explanatory view showing the constitution of the external magnetic screw 14 and the internal magnetic screw 15 in the second embodiment.

FIG. 4 shows the constitution of the magnetic screw section of the rotary actuator in the second embodiment. On the forward end of the rod 17 is fixedly mounted the external magnetic screw 14. On the right end face of the external magnetic screw 14, a guide shaft 14*a* is formed.

The rotary shaft 12 is rotatably supported on bearings 28 and 29. The rotary shaft 12 is a hollow shaft, in which the internal magnetic screw 15 is fixedly provided. In this rotary shaft 12 is provided a guide hole 30*a*. In this guide hole 30*a*, the guide shaft 14*a* is slidably fitted, so that the external magnetic screw 14 is slidable while being held at a specific distance from the internal magnetic screw 15 by means of the guide shaft 14*a*.

The cylinder in the second embodiment has an elliptical sectional form and therefore requires no outside locking means for preventing rotation.

The rotary actuator 11 in the second embodiment, as has been explained in detail, has (a) the rod 17 connected to the piston 22, with its one end protruding out of the cylinder tube 20, (b) the external magnetic screw 14 connected to the rod 17 and having a spiral magnetized band 13 formed in parallel with the direction of sliding of a piston 22, and (c) the rotary shaft 12 rotatably inserted in the external magnetic screw 14, and provided with the internal magnetic screw 15 having a spiral magnetized band 16; and (d) with the sliding of the piston 22, the internal magnetic screw 15 receives the magnetic force from the external magnetic screw 14 to rotate the rotary shaft 12. Since the cylinder section is separated from the rotary shaft section, the rotary shaft 12 is little affected by any change arising in the cylinder section such as a change in the sliding resistance of the piston 22 and a change in the air pressure, thereby enabling smooth rotation of the rotary shaft 12 and maintaining a constant torque of the rotary shaft 12.

Since the external magnetic screw 14 and the internal magnetic screw 15 are coaxially arranged, the sectional area of the rotary actuator 11 can be decreased on the whole, thereby reducing the mounting space.

Figure 5:
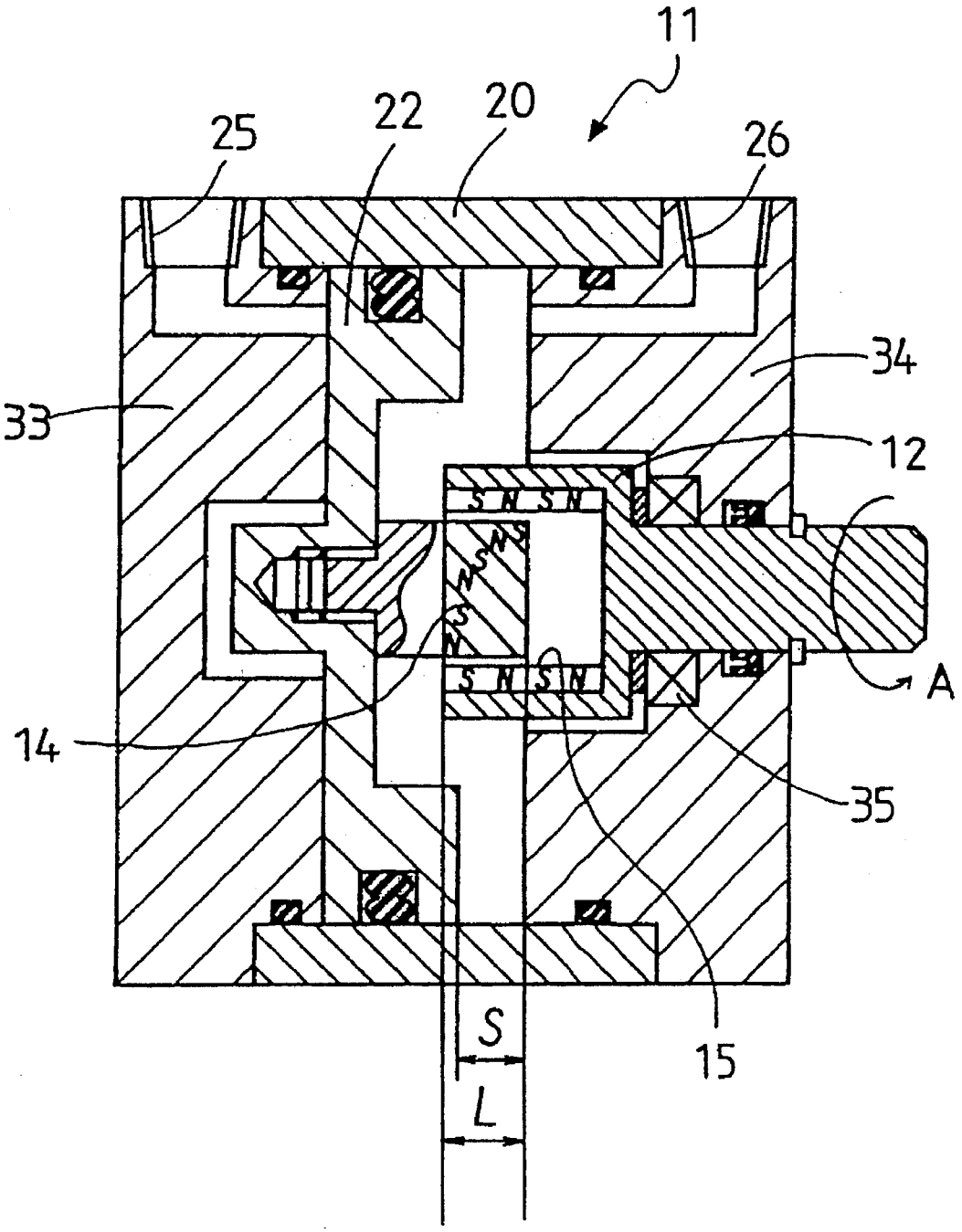
FIG. 5 is a sectional view showing the constitution of a rotary actuator 11 in a third embodiment according to the present invention.

The constitution of the rotary actuator 11 in a third embodiment is shown in a sectional view of FIG. 5.

The cylinder body is composed of a hollow cylindrical cylinder tube 20 and a left end cover 33 and a right end cover 34 which close both ends of the cylinder tube 20. A rotary shaft 12 is rotatably supported through the center of the right end cover 34 on a rotating bearing 35 secured on the right end cover 34.

Inside of the cylinder tube 20, a piston 22 is axially slidably fitted in relation to the rotary shaft 12. The piston 22 and the cylinder tube 20 have an elliptical sectional form and therefore the piston 22 slides in the cylinder tube 20 without rotating.

Figure 8:
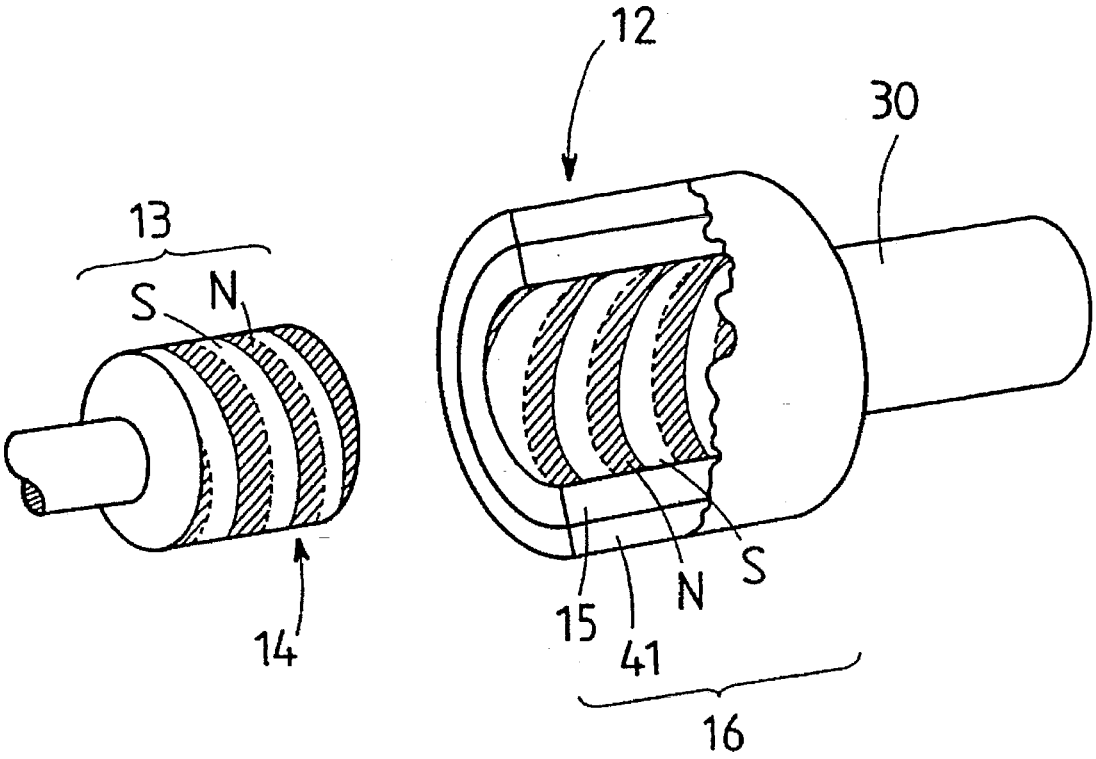
FIG. 8 is an explanatory view showing the constitution of the external magnetic screw 14 and the internal magnetic screw 15 in the third embodiment.

There is provided a screw hole at the center of the end face of the piston 22 on the rotary shaft 12 side. In the screw hole, an external magnetic screw 14 is threadedly secured. The external magnetic screw 14 consists of a large-diameter portion and a small-diameter portion; on the small-diameter portion is formed a screw section. On the peripheral surface of the large-diameter portion, a spiral magnetized band 13 is formed as shown in FIG. 8. Adjacent magnetized bands 13 have different polarities. That is, when a certain magnetized band 13 is polarized as a north pole N on the outside surface, the adjacent magnetized band 13 has a south pole S on the outside surface.

The rotary shaft 12, as shown in FIG. 8, is composed of a rotary shaft section 30 and an internal magnetic screw section 41 having a hollow section. In the hollow section of the internal magnetic screw section 41, the internal magnetic screw 15 is fixed in a position corresponding to the external magnetic screw 14.

Next, the general constitution of the rotary actuator 11 will be explained with reference to FIG. 5. The external magnetic screw 14 is secured to the piston 22 by a screw section formed on the small-diameter portion.

In the drawing, the length L of the external magnetic screw 14 indicates the coupling length between an internal magnetic screw magnet 15 and the external magnetic screw 14. The coupling force between the external magnetic screw 14 and the internal magnetic screw 15 depends on the coupling length L and the strength of magnet.

A stroke S is the stroke through which the piston 22 moves.

Next, the function of the third embodiment will be explained.

FIG. 5 shows the rotary actuator with the piston 22 pushed to the left side with the compressed air supplied at the air port 26.

Next explained is the supply of the compressed air switched from the air port 26 to the air port 25.

The piston 22 is moved to the right with the compressed air. The piston 22, having an elliptical sectional form, does not rotate. With the rightward stroke of the piston 22, the external magnetic screw 14 also moves together, and therefore the external magnetic screw magnet 15 receives the magnetic force from the external magnetic screw 14, thereby rotating the rotary shaft 12 counterclockwise as viewed from the right as indicated by the arrow A in the drawing.

Here, because the external magnetic screw 14 formed integrally with the piston 22 has the spiral magnetized band 13 on the entire outer periphery and also the internal magnetic screw magnet 15 formed integrally with the rotary shaft 12 has a spiral magnetized band 16 on the entire inner periphery, the internal magnetic screw magnet 15 receives the magnetic force from the external magnetic screw 14 with the sliding of the piston 22, to thereby rotate the rotary shaft 12, thus ensuring smooth, stable rotation of the rotary shaft 12.

According to the rotary actuator 11 in the present embodiment, as heretofore explained in detail, (a) the piston 22 is formed in parallel with the direction of sliding, and has the external magnetic screw 14 integrally having the spiral magnetized band 13 on the entire outer periphery, (b) the rotary shaft 12 is rotatably mounted on the right end cover 34, and has the internal magnetic screw magnet 15 integrally having the spiral magnetized band 16 on the entire inner periphery, and (c) with the sliding of the piston 22, the internal magnetic screw magnet 15 receives the magnetic force from the external magnetic screw 14 to rotate the rotary shaft 12; therefore when the internal magnetic screw magnet 15 receives the magnetic force from the internal magnetic screw 14 with the sliding of the piston 22, the rotary shaft 12 rotates smoothly and no rotational nonuniformity will occur.

Also since the external magnetic screw 14 and the internal magnetic screw magnet 15 constantly attract each other, the rotary shaft 12 can be rotated with a constant torque.

Furthermore, the rotary actuator 11 has the following advantage that since it is unnecessary to mount the internal magnetic screw magnet 15 through the piston 22 as compared with the case where the external magnetic screw 14 is formed on the rotary shaft 12 side and the internal magnetic screw magnet 15 is secured on the piston 22 side, a seal in the magnetic screw section is dispensed with.

Furthermore, since no seal is needed in the magnetic screw section, it is possible to increase the coupling force between the external magnetic screw 14 and the internal magnetic screw magnet 15 without decreasing the transmission torque of the magnetic screw.

Furthermore, as no seal is needed in the magnetic screw section, the overall length of the cylinder tube 20 can be decreased to allow building of a compact rotary actuator and accordingly simplification of the construction of the rotary actuator, thus lowering the cost.

Figure 6:
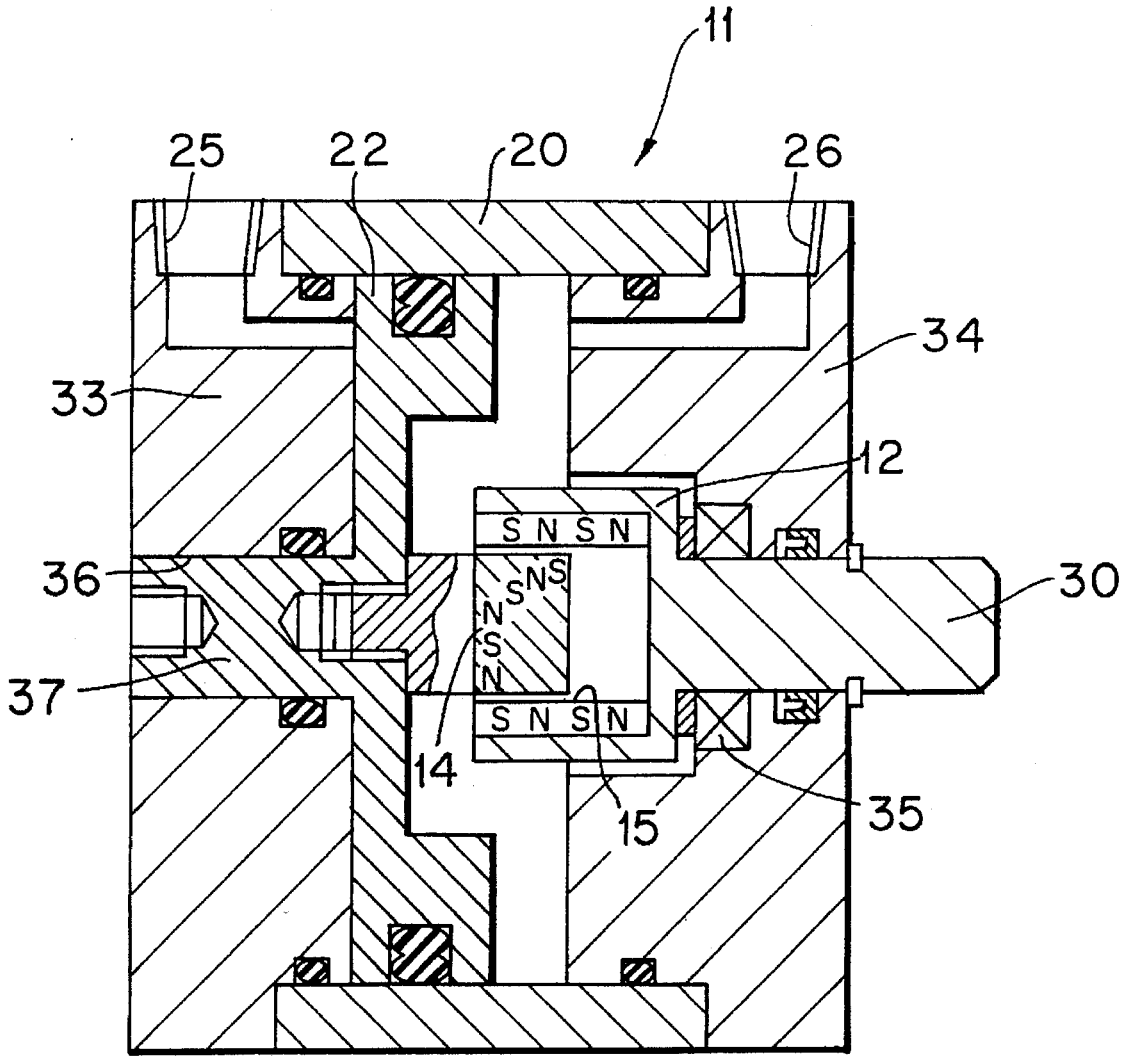
FIG. 6 is a sectional view showing the constitution of a rotary actuator 11 in a fourth embodiment according to the present invention.

Next, a fourth embodiment of the present invention will be explained. FIG. 6 is a sectional view showing the constitution of a rotary actuator 11 in the fourth embodiment. Since the rotary actuator is much the same in constitution as the third embodiment, only a difference will be explained.

The difference of the fourth embodiment resides in the respect that an opening 36 is formed at the center of a left end cover 33, and in this opening 36, a manual switch 37 is slidably fitted as a manual operating means protruding from a piston 22. As shown in FIG. 6, with the piston 22 held in contact with the left end cover 33, a manual switch 37 is flush with the surface of the left end cover 33.

When the manual switch 37 is depressed, the piston 22 is moved towards the right regardless of air supply, giving the magnetic force to an internal magnetic screw magnet 15 from an external magnetic screw 14, thus rotating a rotary shaft 12. When no air is being supplied, therefore, the rotary actuator can be driven to facilitate adjustments thereof.

Figure 7:
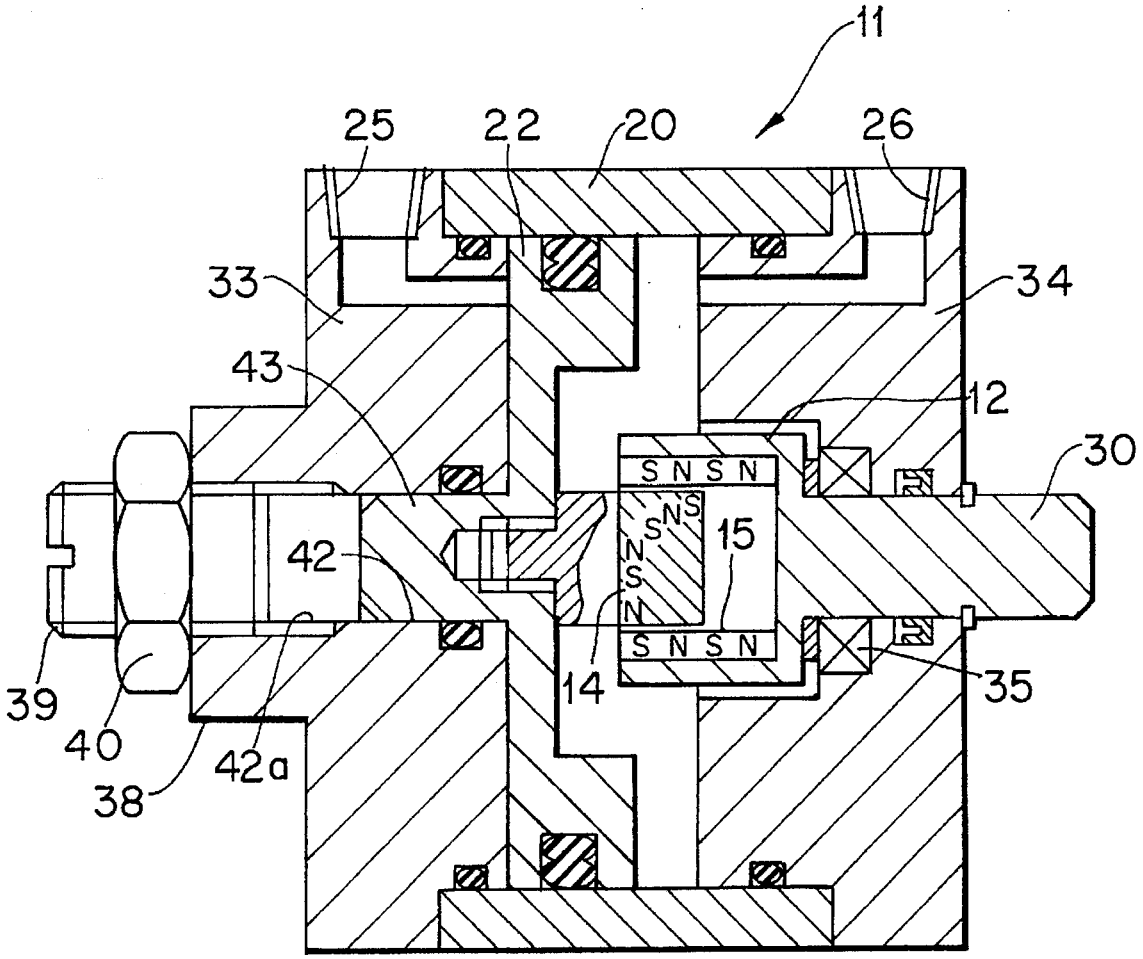
FIG. 7 is a sectional view showing the constitution of a rotary actuator 11 in a fifth embodiment according to the present invention.

Next, the fifth embodiment of the present invention will be explained with reference to FIG. 7.

An explanation will be given only of differences of a rotary actuator 11 in the fifth embodiment from the rotary actuator 11 in the third embodiment. The fifth embodiment differs only in the points that an opening 42 is formed at the center of a left end cover 33 and a projecting portion 38 is formed on the left end face of the left end cover 33, and also that a projecting portion 43 is formed on the left end face of a piston 22 and fitted in the opening 42; the piston 22 being held in position in contact with a stopper screw 39 locked by an internal screw 42*a*. The stopper screw 39 is locked by a lock bolt 40.

According to the fifth embodiment, the stop position of the piston 22 can be changed by locking the stopper screw 39 in an arbitrary position and therefore a rotary shaft 12 can be stopped in any desirable position of rotation.

In the fifth embodiment, the stopper with the piston 22 on the left position has been explained. It should be noted that the rotary shaft 12 can be stopped at any desired stop position when the piston 22 has come to the right position, by projecting the projecting portion of the piston 22 out of the cylinder through an opening 35 and by fitting the stopper to the projecting portion, thereby stopping the rotary shaft 12 in any arbitrary position of rotation.

Figure 9:
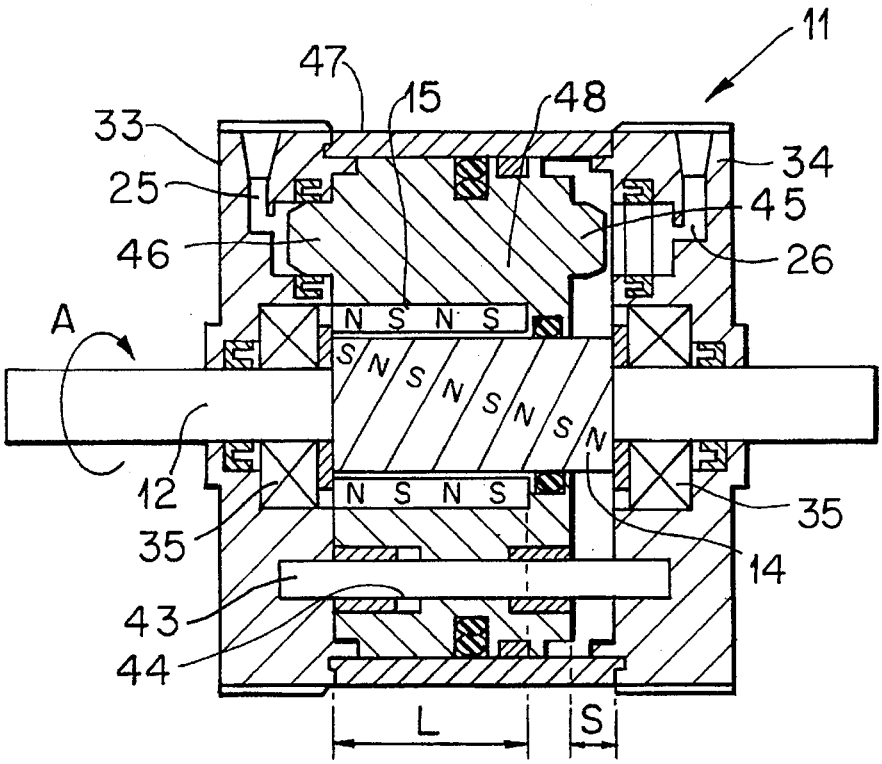
FIG. 9 is a sectional view showing the constitution of a rotary actuator 11 in a sixth embodiment according to the present invention.

FIG. 9 is a sectional view showing the constitution of a rotary actuator 11 in a sixth embodiment. The constitution of the rotary actuator 11 is generally the same as that of the third embodiment and therefore only differences will be explained.

Through the center of end covers 33 and 34, a rotary shaft 12 is rotatably supported on a couple of rotating bearings 35 fixedly mounted on the end covers 33 and 34.

Figure 11:
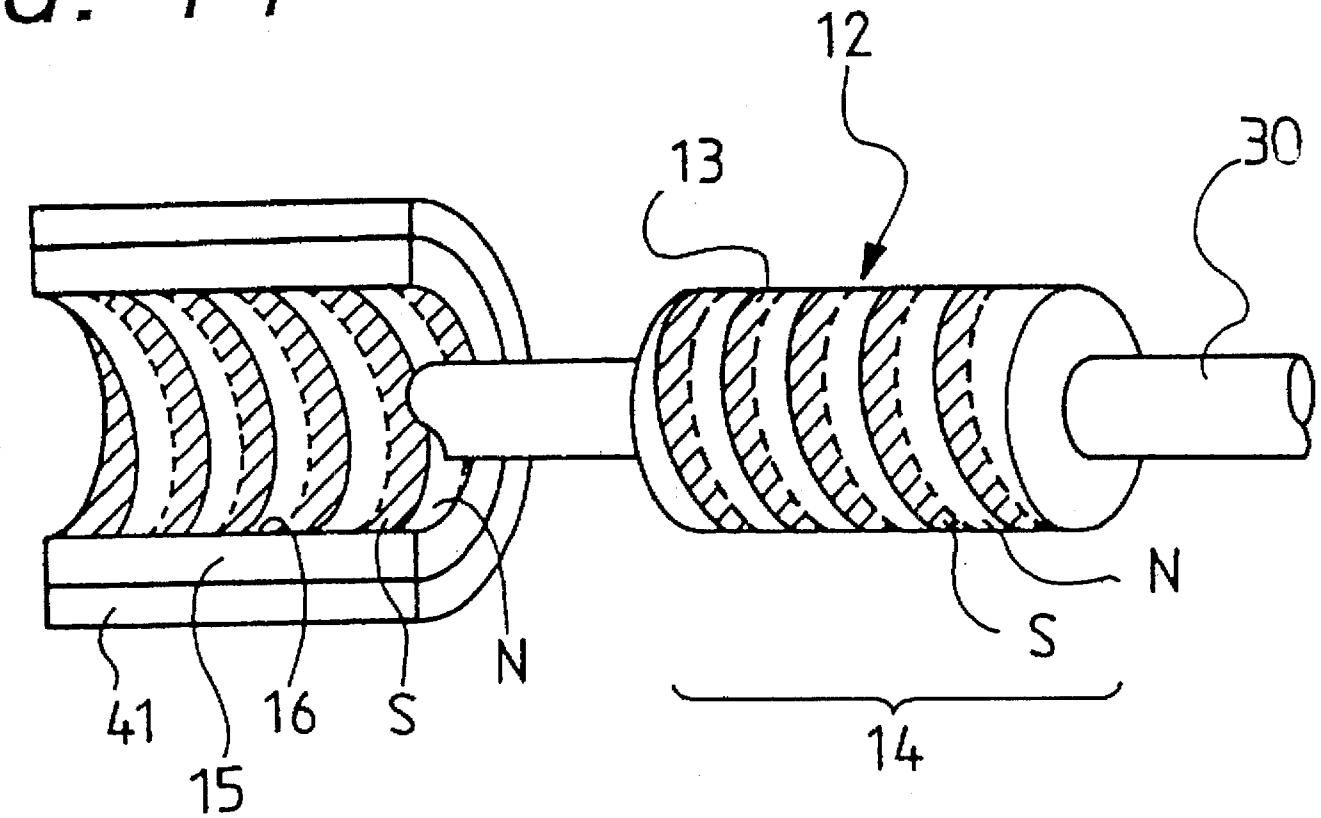
FIG. 11 is an explanatory view showing the constitution of the external magnetic screw 14 and the internal magnetic screw 15 in the sixth embodiment.

On the surface of an external magnetic screw 14 of the rotary shaft 12 are orderly formed magnetized bands 13 alternately polarized as a north pole N and a south pole S in a spiral form as shown in FIG. 11.

Inside an internal magnetic screw section 41, an internal magnetic screw 15 is fixed in a position corresponding to an external magnetic screw 14. On the inner periphery of the internal magnetic screw 15 is formed a magnetized band 16 polarized as the north pole N and the south pole S alternately arranged in a spiral form as shown in FIG. 11.

Next, in FIG. 9, an explanation of the general constitution of the rotary actuator 11 will be continued. The internal magnetic screw section 41 is fixedly installed to a piston 17.

Beneath the rotary shaft 12, a guide pin 43 is fixedly installed on the end covers 33 and 34. In a position corresponding to the guide pin 43 of a piston 22 is provided a guide hole 44, in which the guide pin 43 is slidably fitted. The piston 22 is thus prevented from rotating around the rotary shaft 12.

On the end face of the piston 22 on the opposite side of the guide hole 44, shock-absorbing projections 45 and 46 are formed. In the positions corresponding to the projections 45 and 46 of the end covers 33 and 34, recessed sections are formed. To these recessed sections are connected air ports 26 and 25.

In FIG. 9, the length L of the internal magnetic screw 15 indicates the length of the coupling between the internal magnetic screw 15 and the external magnetic screw 14. The coupling force between the external magnetic screw 14 and the internal magnetic screw 15 depends on the coupling length L and the magnet strength.

The stroke S represents the stroke through which the piston 17 moves.

Next, the operation of the rotary actuator 11 having the above-described constitution will be explained.

FIG. 9 shows the piston 17 pressed to the left side with the compressed air supplied through the air port 26.

Next, the supply of the compressed air switched from the air port 26 to the air port 25 will be explained.

The piston 22 pushed by the compressed air slides rightwards. At this time, because the guide pin 43 is fitted in the guide hole 44, the piston 22 cannot rotate. With the rightward movement of the piston 22, the internal magnetic screw 15 moves together, and therefore, the external magnetic screw 14 receives the magnetic force from the internal magnetic screw 15, turning the rotary shaft 12 counterclockwise as viewed from the left as indicated by the arrow A in the drawing.

Here, since the internal magnetic screw 15 formed integrally with the piston 22 has a spiral magnetized band 16 on the entire inner periphery and also the external magnetic screw 14 formed integrally with the rotary shaft 12 has the spiral magnetized band 13 on the entire outer periphery, the external magnetic screw 14 receives the magnetic force from the internal magnetic screw 15 as the piston 22 slides, thus ensuring smooth, stable rotation of the rotary shaft 12.

Also, a projection 45 fits in the recessed section in the right end cover 34 before the piston 22 collides against the right end cover 34. At this time, since the displacement of the air port 26 is throttled by a control valve, not illustrated, the piston 22 can come into soft contact with the right end cover 34 owing to the use of an air cushion.

Figure 10:
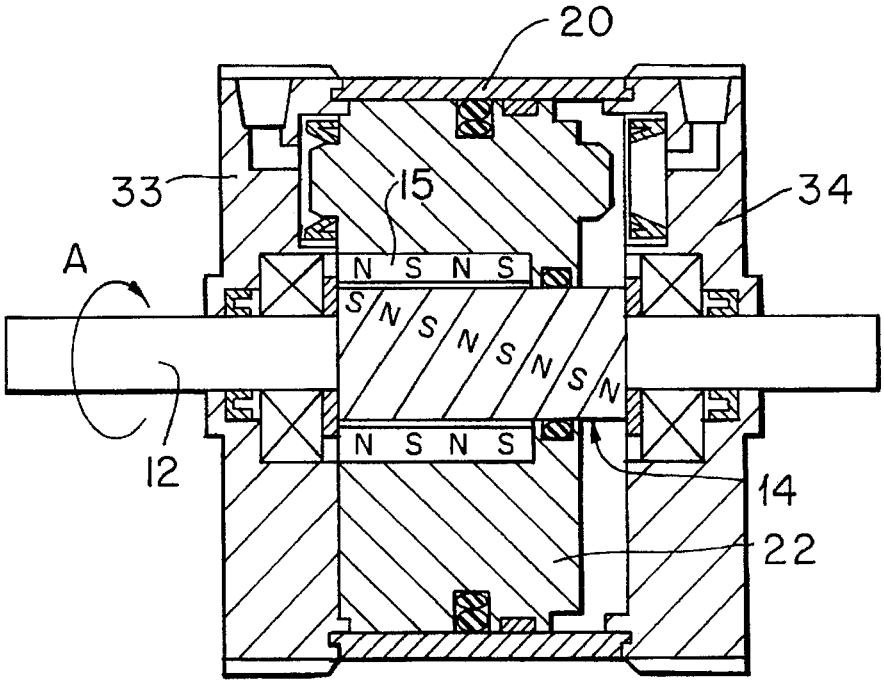
FIG. 10 is a sectional view showing the constitution of a rotary actuator 1 in a seventh embodiment according to the present invention.

Next, a seventh embodiment of the present invention will be explained. FIG. 10 is a sectional view showing the constitution of a rotary actuator 11 in the seventh embodiment, which is generally of the same constitution as the sixth embodiment; therefore only a difference will be explained hereinafter.

The difference from the sixth embodiment is that the piston 22 has an elliptical or oblong sectional form, to thereby prevent rotation around a rotary shaft 12. A cylinder tube 20, and end covers 33 and 34 have been formed to the shape of a piston 22.

According to the seventh embodiment, a guide pin 43 and a guide hole 44 are not needed, and therefore, it is possible to simplify the construction of the rotary actuator 11.

Figure 12:
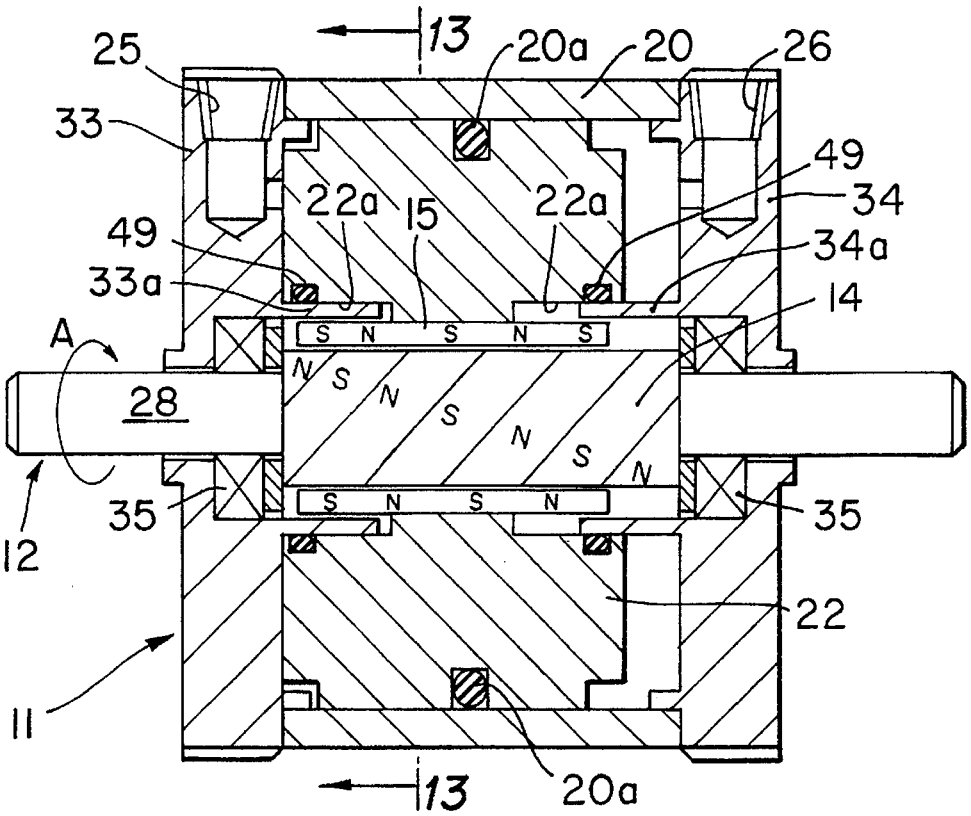
FIG. 12 is a sectional view showing the constitution of a rotary actuator 11 in an eighth embodiment according to the present invention.
Figure 13:
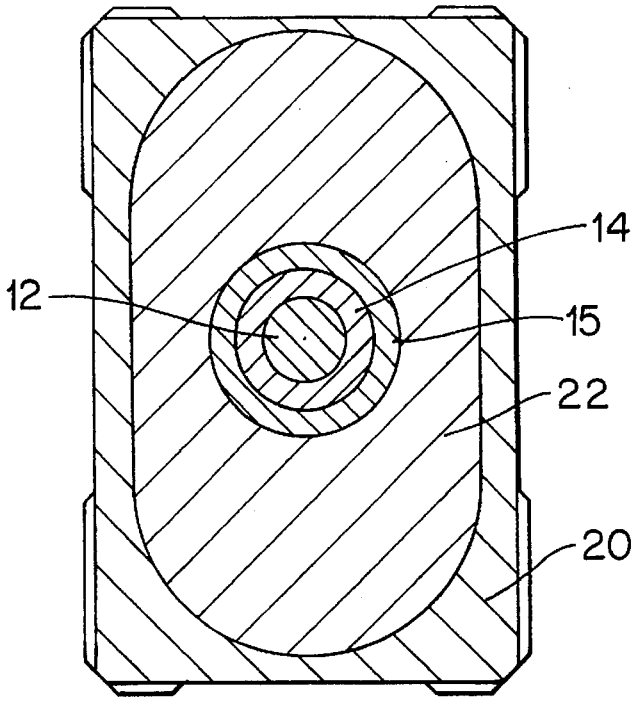
FIG. 13 is a sectional view taken along line 13—13 of FIG. 12.

Next, the constitution of a rotary actuator 11 in an eighth embodiment according to the present invention will be shown in the sectional view of FIG. 12. FIG. 13 shows the sectional view taken along line 13—13 of FIG. 12.

The construction of this rotary actuator is basically the same as that of the sixth embodiment; hereinafter, therefore, only a difference will be explained.

Inside a cylinder tube 20, a piston 22 is axially slidably inserted. The piston 22 has an elliptical outer periphery as shown in FIG. 13. The use of the elliptical piston is for preventing the piston 22 from rotating.

Inside the piston 22 is fixedly mounted an internal magnetic screw 15 in a position corresponding to an external magnetic screw 14. On the outer periphery of the piston 22 is formed a groove for mounting a seal member, in which an O-ring 20*a* is retained.

The internal magnetic screw 15 is secured at the central portion on the inner periphery of the central projection of the piston 22. Thus, a circumferential groove 22*a* is formed of the inner periphery of the piston 22 and the internal magnetic screw 15. In the inner periphery of the piston 22 is formed an O-ring groove, in which an O-ring 49 is retained as an elastic seal member.

In the meantime, a right seal guide 33*a* and a left seal guide 34*a*, inserted in the circumferential grooves 22*a*, are formed on the left end cover 33 and the right end cover 34. And the O-rings 49 retained in the inner periphery of the piston 22 are in contact with these seal guides 33*a* and 34*a*.

Next, the operation of the rotary actuator 11 having the aforesaid constitution will be explained.

FIG. 12 shows the state where the compressed air is supplied to an air port 26 to press a piston 17 to the left side.

Here, to prevent the leakage of the compressed air supplied to the air port 26, the O-ring 49 and the O-ring 20*a* are employed.

Next, switched supply ports of the compressed air from the air port 26 to another air port 25 will be explained.

The piston 22 is pushed to slide rightwards with the compressed air. The compressed air supplied at the air port 25 to the left side of the piston 22 is prevented from leakage by means of the two O-rings 49 and 20*a*.

With the rightward movement of the piston 22, the internal magnetic screw 15 also moves together, and the external magnetic screw 14 receives the magnetic force from the internal magnetic screw 15, thus rotating the rotary shaft 12 counterclockwise as viewed from the left as indicated by the arrow A in the drawing.

Here, the O-ring 49 contacts the left seal guide 33*a*, but is off the rotary shaft 12, and therefore will not affect the output torque of the rotary shaft 12, increasing the torque of the rotary shaft 12 and reducing an output torque variation of the rotary shaft 12.

Figure 14:
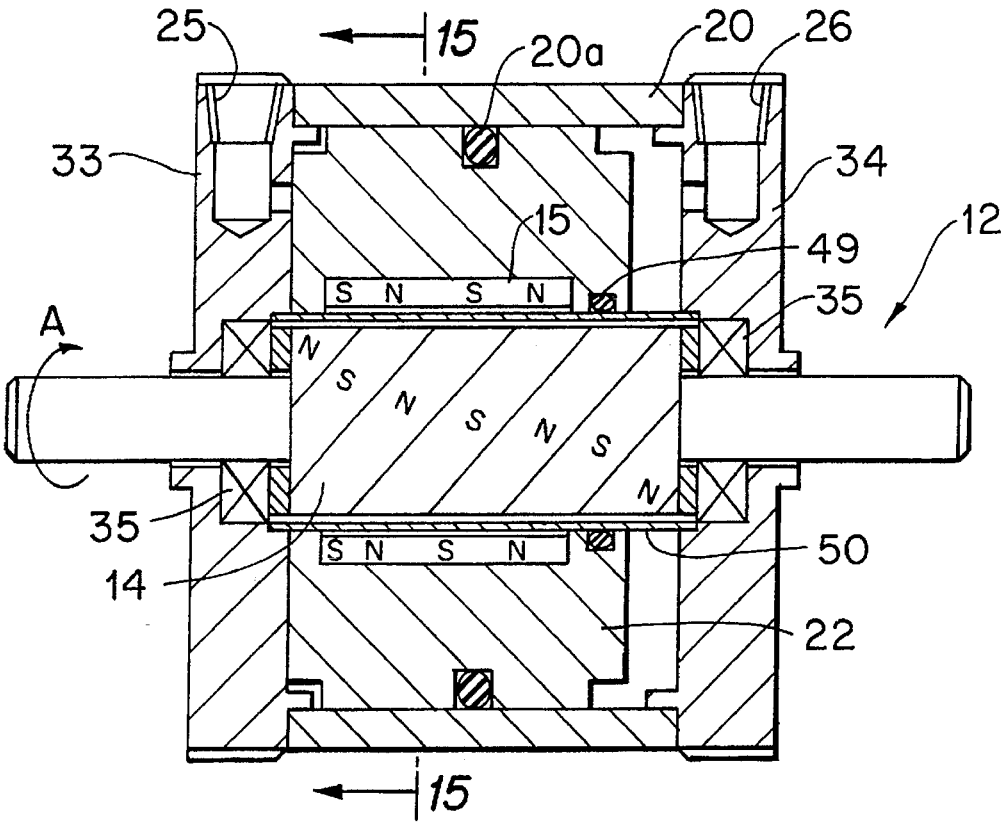
FIG. 14 is a sectional view showing the constitution of a rotary actuator 11 in a ninth embodiment according to the present invention.
Figure 15:
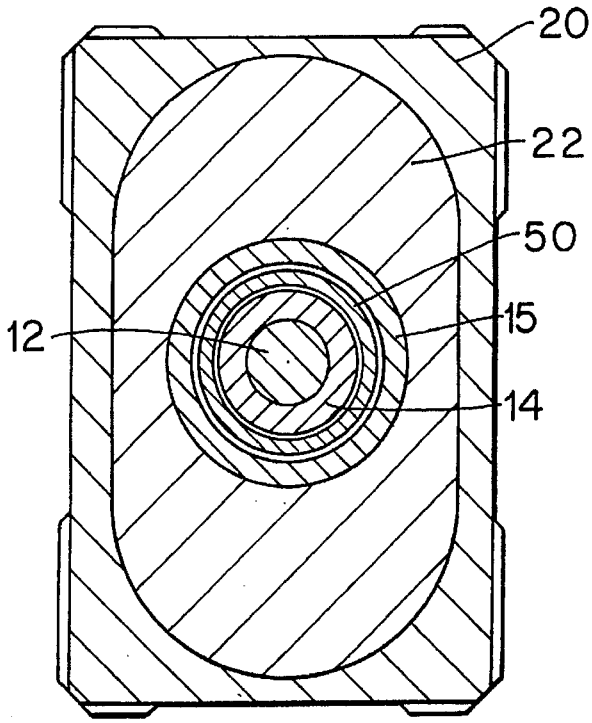
FIG. 15 is a sectional view taken along line 15—15 of FIG. 14.

Next, a ninth embodiment of the present invention will be explained. FIG. 14 is a sectional view showing the constitution of a rotary actuator 11 in the ninth embodiment. FIG. 15 is a sectional view taken along line 15—15 of FIG. 14. Since the ninth embodiment is almost the same in constitution as the eighth embodiment, only a difference will be explained.

The difference of the ninth embodiment lies in that the rotary actuator is not provided with a cylindrical groove 22*a*, a right seal guide 33*a*, and a left seal guide 34*a*, but is provided with a nonmagnetic seal tube 50 retained at both ends with both a left end cover 33 and a right end cover 34, and that an O-ring 49 is in contact with the seal tube 50.

According to the ninth embodiment, the O-ring 49 provided on the inner periphery of a piston 22 is in contact with the nonmagnetic seal tube 50 by the end covers 33 and 34, to thereby close the air chambers on both sides of the piston 22, thus preventing leakage of the compressed air and giving no effect to the rotating torque of the rotary shaft 12. The rotary shaft 12, therefore, can rotate with a great torque to produce a stable torque.

Figure 16:
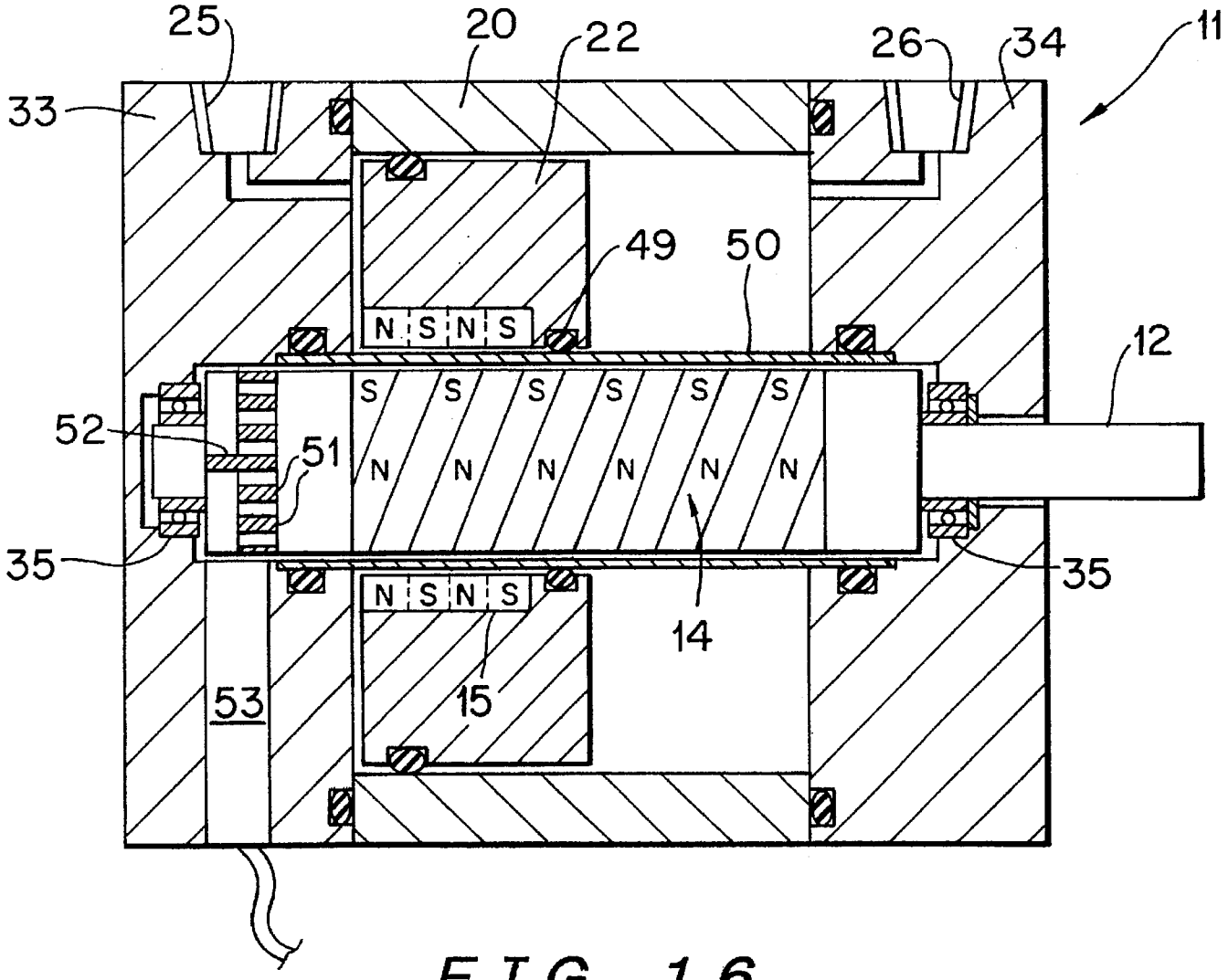
FIG. 16 is a sectional view showing the constitution of a rotary actuator 11 in a tenth embodiment according to the present invention.

Next, the constitution of a rotary actuator 11 in a tenth embodiment according to the present invention will be shown in the sectional view of FIG. 16. The basic constitution of this rotary actuator 11 is the same as that of the ninth embodiment, and therefore only a difference will be explained herein.

In the cylinder, a seal pipe 50 enclosing the outer periphery of a rotary shaft 12 is retained by end covers 33 and 34. In a piston 22, an O-ring 49 is retained in contact with the seal pipe 50 to prevent air leakage.

Figure 17:
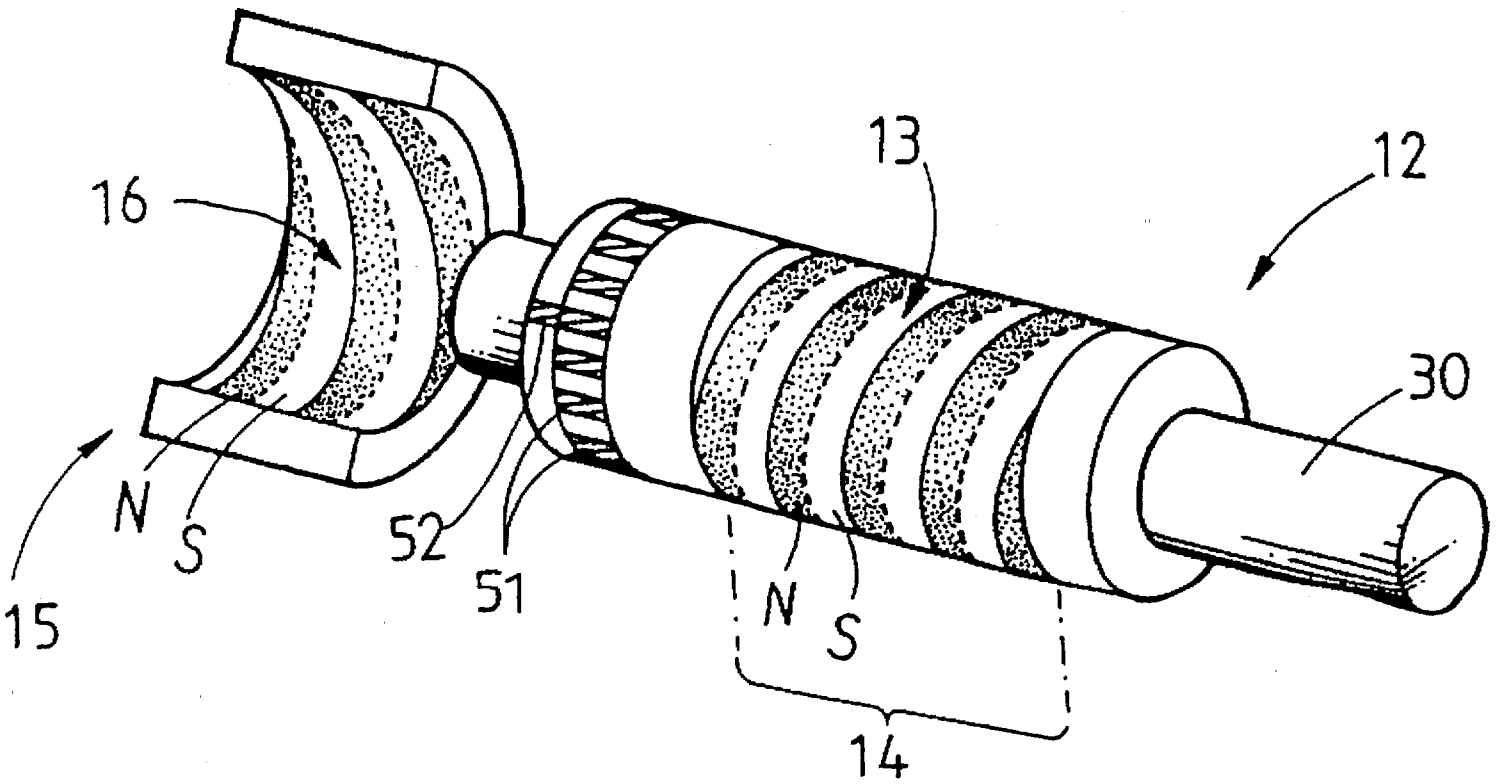
FIG. 17 is an explanatory view showing the constitution of the external magnetic screw 14 and the internal magnetic screw 15 in the tenth embodiment.
Figure 18:
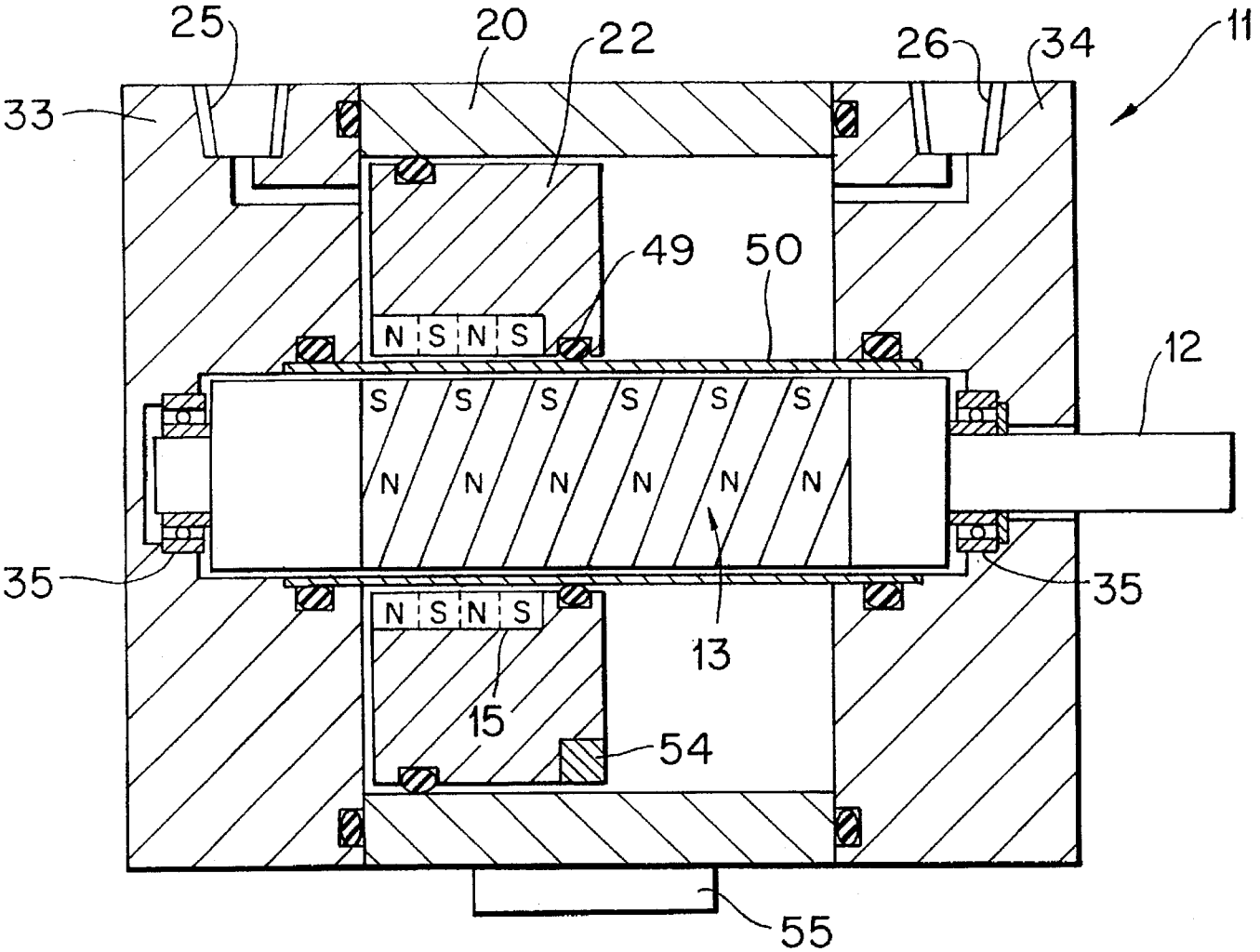
FIG. 18 is a sectional view showing the constitution of a rotary actuator 11 in an eleventh embodiment according to the present invention.
Figure 19:
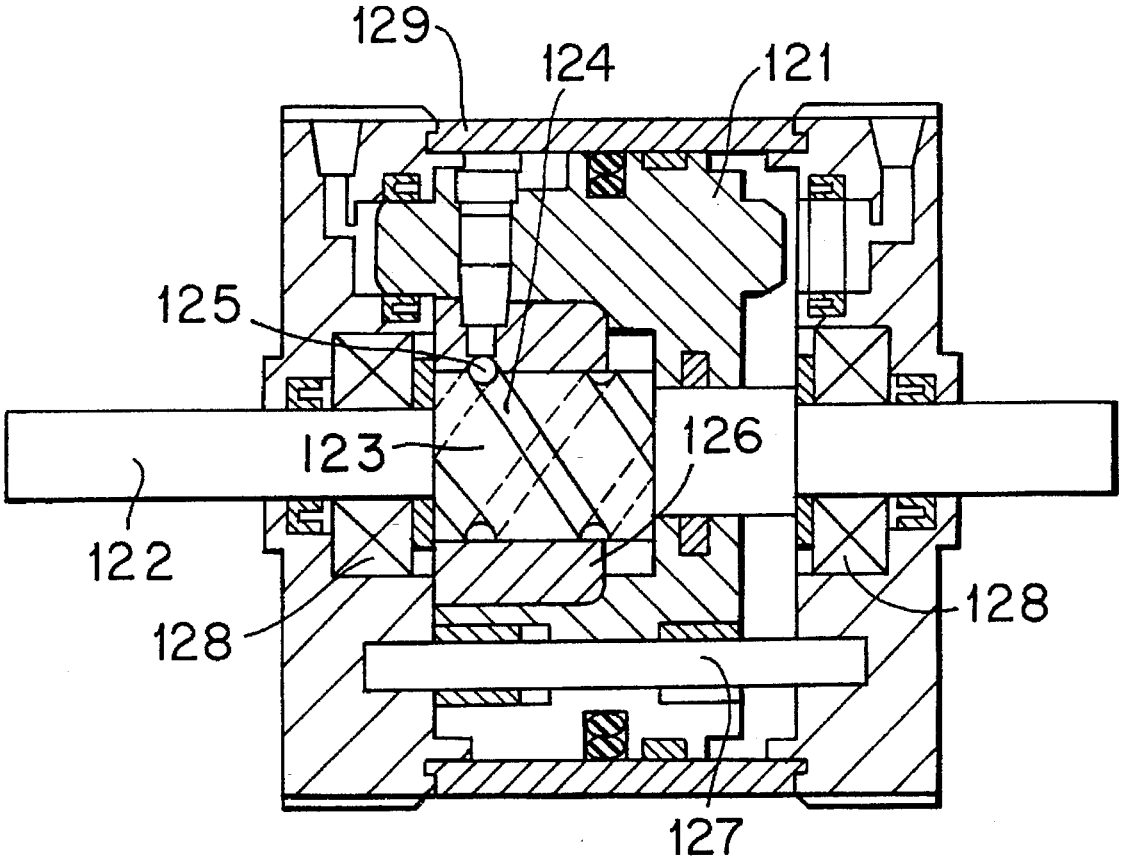
FIG. 19 (PRIOR ART)
FIG. 19 is a sectional view showing the constitution of a prior art ball-screw type rotary actuator.
Figure 20:
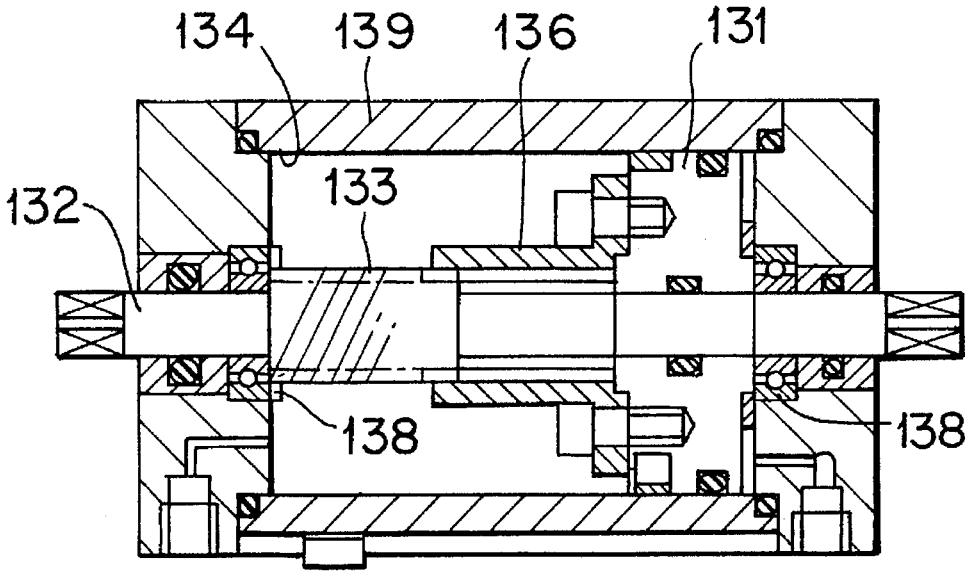
FIG. 20 (PRIOR ART)
FIG. 20 is a sectional view showing the constitution of a prior art screw type rotary actuator.
Figure 21:
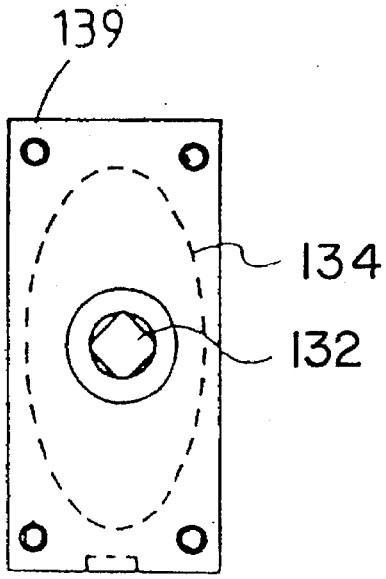
FIG. 21 (PRIOR ART)
FIG. 21 is a side view of the prior art screw type rotary actuator.
Figure 22:
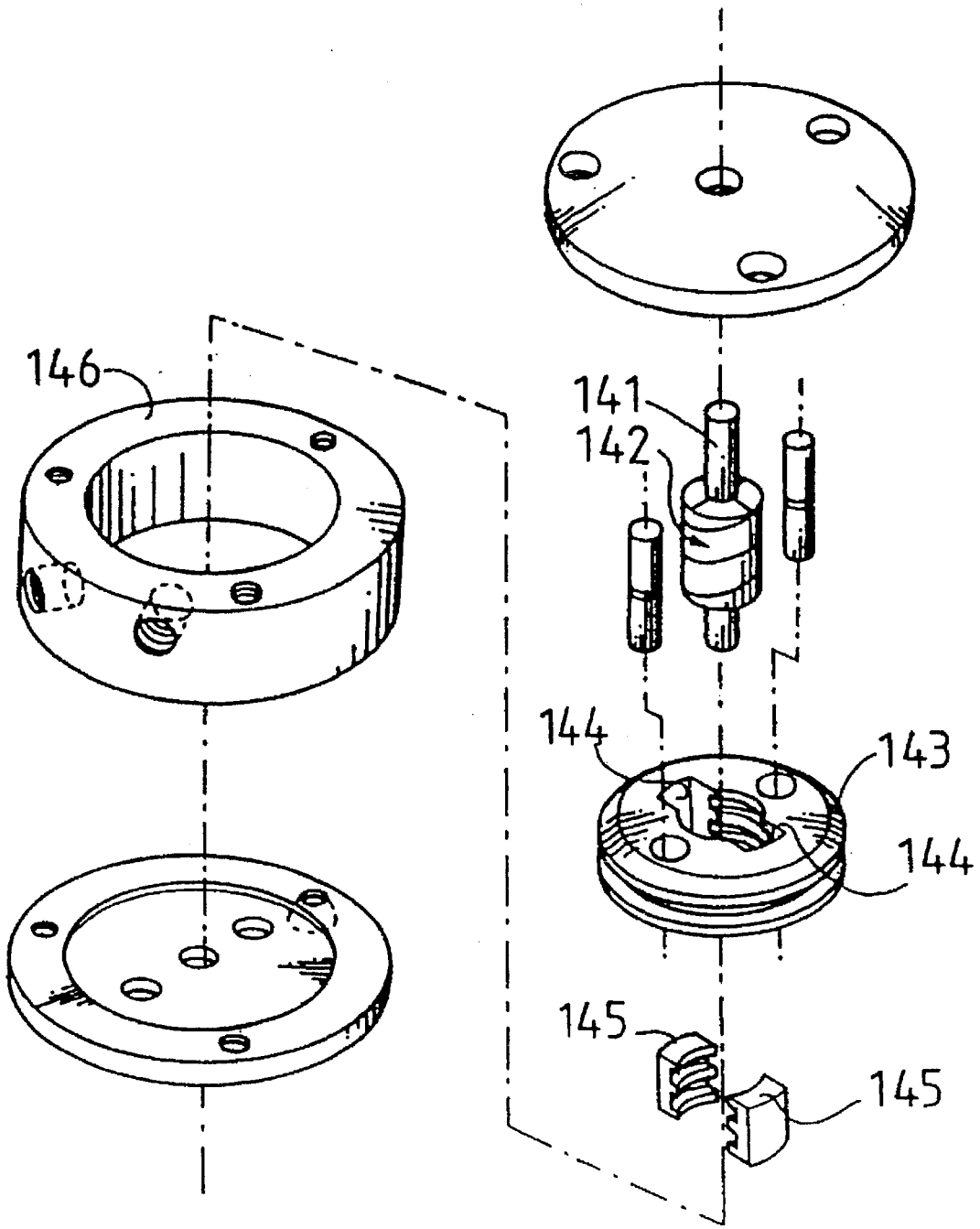
FIG. 22 (PRIOR ART)
FIG. 22 is an exploded perspective view showing the constitution of a prior art magnetic screw type rotary actuator.

As shown in FIG. 17, on the outer periphery of the large-diameter portion of the rotary shaft 12 are formed an internal magnetic screw 14 on which a spiral magnetized band 13 as a first magnetized band, an encoder magnetized band 51 with a pole N and a pole S alternately magnetized at a specific pitch on the outer periphery, and a home-position magnetized band 52 for indicating a home position. The actual pitch of the encoder magnetized band 51 is set much finer, but is magnified for good visibility.

The encoder magnetized band 51 has the north pole N and the south pole S which are alternately arranged at a specific pitch on the outer periphery in parallel with the shaft. The home-position magnetized band 52, as explained later, has the north pole N formed in a position corresponding to the home-position detecting section of an encoder sensor 53 when the piston 22 is in the extreme left position.

On the left end cover 33 is provided the encoder sensor 53 in a position corresponding to the encoder magnetized band 51 and the home-position magnetized band 52.

Next, the operation of the rotary actuator 11 having the above-described constitution will be explained.

FIG. 16 shows the piston 22 pressed to the left side with the compressed air supplied at an air port 26.

In this state, the home-position magnetized band 52 is in a position corresponding to the home-position detecting section of the encoder sensor 53, and therefore, the encoder sensor 53 can determine that the rotary shaft 12 is in the home position.

Next, the supply of the compressed air switched from the air port 26 to another air port 25 will be explained.

The piston 22 is moved rightwards by the compressed air. At this time, the piston 22, being of the elliptical or oblong shape, will not rotate. With the rightward movement of the piston 22, an internal magnetic screw 15 also moves together; and therefore, the external magnetic screw 14 receives the magnetic force from the internal magnetic screw 15, thus driving the rotary shaft 12 clockwise as viewed from the right as indicated by the arrow A in the drawing.

Here as the rotary shaft 12 rotates, the encoder magnetized band 51 formed at a specific pitch on the outer periphery of the rotary shaft 12 rotates in relation to the encoder sensor 53. The encoder sensor 53 computes the rotational angle of the rotary shaft 12 by detecting a change in the north pole N and the south pole S of the encoder magnetized band 51. In the rotary actuator 11 of the present embodiment, the encoder sensor 53 serves also as a rotational position detecting means and rotational angle detecting means.

It is, therefore, possible to detect to decide that the rotary shaft 12 is at the specific angle of rotation if no detector for detecting the rotational position of the rotary shaft 12 is mounted outside. Also, a trouble can be detected if the rotary shaft 12 will not come within the specific angle even after a lapse of a specific time.

Next, an eleventh embodiment will be explained. The eleventh embodiment is of the same constitution as the tenth embodiment, and only a difference will be explained.

A rotary shaft 12 of a rotary actuator 11 in the eleventh embodiment is not provided with the encoder magnetized band 51 and a home-position magnetized band 52. Also, a permanent magnet 54 is bonded in a groove formed in the outer periphery of a piston 22. Outside of a cylinder tube 20, a position detector 55 is mounted in a position corresponding to the permanent magnet 54.

The position detector 55 may be such one that detects the position of the permanent magnet 54 at one position or such a linear detector that linearly detects the position. For the linear detector such a magnetic resistance element that a value of resistance varies with the magnetic field strength may be used. The magnetic resistance element is a well-known component, and will not be explained herein.

According to the eleventh embodiment, the rotational angle of the rotary shaft 12 can be detected and determined by detecting the position of the piston 22 in the direction of sliding; therefore it is unnecessary to provide an encoder sensor 53 in the rotary actuator 11, thereby realizing cost reduction.

Furthermore, the body of a standard type rotary actuator, if provided with the permanent magnet 54, is commonly usable in the rotary actuator 11 in which the detection of the rotational angle is not required.

What is claimed is:

1. A rotary actuator having a closed hollow cylinder, a piston slidable within said cylinder, and a rotary shaft rotatable upon sliding movement of said piston, said rotary actuator comprising:

a first magnetic screw member having a first continuous spiral magnetized band and movable linearly in synchronization with sliding movement of said piston;

said rotary shaft being rotatably supported in relation to said first magnetic screw member and having a second magnetic screw having a second continuous spiral magnetized band;

said first and second spiral magnetized bands having opposite magnetic polarity whereby said second magnetic screw receives a magnetic force from said first magnetic screw upon sliding movement of said piston, thereby rotating said rotary shaft.

2. The rotary actuator according to claim 1, wherein said first magnetic screw member is connected to a rod formed integrally with said piston outside of said cylinder; and said rotary shaft is rotatably supported relative to said first magnetic screw member outside of said cylinder.

3. The rotary actuator according to claim 2, wherein said first magnetic screw has an internal periphery, the first spiral magnetized band being formed on the internal periphery, and said second magnetic screw has an external periphery, the second spiral magnetized band being formed on the external periphery.

4. The rotary actuator according to claim 2, wherein said first magnetic screw is an external magnetic screw having an outer periphery, the first spiral magnetized band being formed on the outer periphery, and said second magnetic screw is an internal magnetic screw having an inner periphery, the second spiral magnetized band being formed on the inner periphery.

5. The rotary actuator according to claim 4, wherein said external magnetic screw and said internal magnetic screw are coaxially positioned.

6. The rotary actuator according to claim 1, wherein said cylinder includes a pair of end members, said first magnetic screw being formed integrally with said piston; and wherein said rotary shaft is rotatably mounted relative to said first magnetic screw within said cylinder and having one end protruding out of one of said pair of end members of said cylinder.

7. The rotary actuator according to claim 6, wherein said first magnetic screw has an inner periphery, the first spiral magnetized band being formed on the inner periphery; and wherein said second magnetic screw has an outer periphery, the second spiral magnetized band being formed on the outer periphery.

8. The rotary actuator according to claim 7, wherein said rotary shaft is rotatably supported by only one of said pair of end members.

9. The rotary actuator according to claim 7, wherein an end portion of said piston is presented on an exterior surface of one of said end members, to form a manual operation means for manually rotating said rod.

10. The rotary actuator according to claim 7, including a rocking angle adjusting member for adjusting the rotation stop position of said rotary shaft by controlling the stop position of said piston.

11. The rotary actuator according to claim 6, wherein said first magnetic screw has an outer periphery, said first spiral magnetized band being formed on the outer periphery; and said second magnetic screw has an inner periphery, said second spiral magnetized band being formed on the inner periphery.

12. The rotary actuator according to claim 11, wherein said rotary shaft is rotatably supported by only one of said pair of end members.

13. The rotary actuator according to claim 11, wherein an end portion of said piston is presented on an exterior surface of one of said pair of end members, to form a manual operation means for manually operating said rotary shaft.

14. The rotary actuator according to claim 11, including a rocking angle adjusting member for adjusting the rotation stop position of said rotary shaft by controlling the stop position of said piston.

15. The rotary actuator according to claim 7, wherein said piston has an inner periphery having circumferential grooves at opposite ends thereof and an elastic seal member in each of the circumferential grooves; each of said pair of end members having a seal guide extending into one of said circumferential grooves of said piston, and being in contact with said elastic seal member.

16. The rotary actuator according to claim 7, wherein said piston has an inner periphery and an elastic seal on the inner periphery of said piston; and wherein said end members block a space defined between said internal magnetic screw of said piston and said external magnetic screw of said rotary shaft, and including a nonmagnetic seal tube in contact with the elastic seal.

17. The rotary actuator according to claim 1, wherein said rotary shaft has an outer periphery and an encoder magnetized band formed at an equal spacing on the outer periphery, and including a rotational angle detector fixedly mounted on said cylinder for detecting said encoder magnetized band to detect the rotational angle of said rotary shaft; and wherein, when said second magnetic screw receives the magnetic force from said first magnetic screw with the sliding of said piston to rotate said rod, said rotational angle detector detects the rotational angle of said rod.

18. The rotary actuator according to claim 1, including a rotational angle detector fixedly mounted on said cylinder to detect the rotational position of said second magnetized band for the purpose of detecting the rotational angle of said rotary shaft; and wherein, when said second magnetic screw receives the magnetic force from said first magnetic screw with the sliding of said piston to rotate said rod, said rotational angle detector detects the rotational angle of said rod.

19. The rotary actuator according to claim 1, wherein said piston has an outer periphery carrying a permanent magnet, and including a position detector mounted outside of said cylinder, for detecting the position of said permanent magnet, and a rotational position detecting means for detecting the rotational position of said rotary shaft on the basis of an output of said position detector when said second magnetic screw receives the magnetic force from said first magnetic screw with the sliding of said piston, to rotate said rotary shaft.

20. The rotary actuator according to claim 19, wherein said position detector is a linear position detector for linearly detecting the position of said permanent magnet, and including a rotational angle detecting means for computation and detection of the rotational angle of said rotary shaft based on an output of said linear position detector.

* * * * *